US012262823B1

(12) United States Patent
DeSena

(10) Patent No.: US 12,262,823 B1
(45) Date of Patent: Apr. 1, 2025

(54) THEFT DETERRENT SLIDE DOWN DOOR ASSEMBLY FOR A MERCHANDISE DISPLAY

(71) Applicant: Henschel-Steinau, Inc., Allendale, NJ (US)

(72) Inventor: Michael D. DeSena, West Caldwell, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 0 days.

(21) Appl. No.: 18/434,083

(22) Filed: Feb. 6, 2024

(51) Int. Cl.
*A47F 5/00* (2006.01)
*A47F 3/00* (2006.01)
*A47F 5/08* (2006.01)

(52) U.S. Cl.
CPC ..... *A47F 5/0068* (2013.01); *A47F 3/002* (2013.01); *A47F 5/0861* (2013.01)

(58) Field of Classification Search
CPC ..... A47F 5/0068; A47F 5/0861; A47F 3/002; G09F 7/18; G09F 7/20
USPC ..... 211/59.2, 119.003, 7; 40/601, 491
See application file for complete search history.

(56) References Cited

U.S. PATENT DOCUMENTS 660,797 A * 10/1900 Huelster ..... A47B 63/02 126/340
2,784,872 A * 3/1957 Lux ..... G07F 11/38 221/241
4,269,326 A * 5/1981 Delbrouck ..... A47F 1/126 221/227
4,682,825 A 7/1987 Crosslen
4,887,737 A * 12/1989 Adenau ..... G07F 11/42 221/192
4,923,261 A * 5/1990 Attardo ..... A47B 88/407 312/303
5,249,855 A 10/1993 Franklin et al.
6,060,661 A * 5/2000 O'Neill ..... A47F 5/0861 220/241
6,082,687 A * 7/2000 Kump ..... G09F 3/204 248/224.51
6,142,317 A * 11/2000 Merl ..... A47F 1/125 211/59.3
6,253,954 B1 * 7/2001 Yasaka ..... G07F 11/42 221/93
6,276,538 B1 * 8/2001 Battaglia ..... A47F 1/12 312/405.1
6,299,002 B1 * 10/2001 Garnier ..... A47F 7/286 211/162

(Continued)

*Primary Examiner* — Jennifer E. Novosad
(74) *Attorney, Agent, or Firm* — Richard M. Goldberg

(57) ABSTRACT

A theft deterrent slide down door assembly for a merchandise display, includes a holder mount mounted to a front of a shelf; a door slidably mounted to the holder mount for movement between a first position in blocking relation to removal of merchandise from the shelf and a second position out of blocking relation to permit removal of an item of merchandise from the shelf upon application of a force to the door; a wound spring connected between the door mounting assembly and the door for automatically returning the door to the first position upon release of the force; and a rack having a plurality of teeth on the door and a pawl on the holder mount in engagement with the teeth for slowing down sliding return movement of the door to the first position and for producing an audible sound during sliding movement of the door.

11 Claims, 22 Drawing Sheets

(56) References Cited

U.S. PATENT DOCUMENTS 6,318,684 B1 * 11/2001 Ireland ..... A47F 5/0068 40/606.15
6,470,611 B1 10/2002 Conway et al.
6,513,667 B2 * 2/2003 Battaglia ..... A47F 1/12 312/405.1
6,802,146 B2 10/2004 Gay
7,032,761 B2 4/2006 Nagel
7,150,365 B2 * 12/2006 Hardy ..... A47F 3/002 211/189
7,182,209 B2 2/2007 Squitieri
7,641,072 B1 * 1/2010 Vlastakis ..... G07G 3/003 221/229
7,665,618 B2 * 2/2010 Jay ..... A47F 1/12 211/59.4
7,690,519 B2 * 4/2010 Kahl ..... A47F 1/12 211/74
7,854,333 B2 * 12/2010 Kottke ..... A47F 1/12 211/59.2
7,882,969 B2 * 2/2011 Gerstner ..... A47F 3/14 211/119.003
8,047,385 B2 * 11/2011 Hardy ..... A47B 73/006 211/59.3
8,152,006 B2 * 4/2012 Wamsley ..... A47F 5/005 211/119.003
8,397,922 B2 * 3/2013 Kahl ..... A47F 7/285 211/59.2
8,622,227 B2 * 1/2014 Bird ..... A47F 3/002 211/119.003
8,800,785 B2 * 8/2014 Kalafut ..... A47F 5/0861 211/119.003
8,973,765 B2 3/2015 Wamsley et al.
9,149,119 B2 * 10/2015 Hansel ..... A47B 96/021
9,240,090 B2 * 1/2016 Vogler ..... G07F 11/38
9,265,358 B2 * 2/2016 Hardy ..... A47B 57/588
9,392,885 B2 * 7/2016 Vogler ..... A47F 1/126
9,451,836 B2 * 9/2016 Szpak ..... A47F 5/005
9,569,941 B1 * 2/2017 Sholl ..... G08B 13/149
9,578,976 B2 * 2/2017 Grubbs ..... A47F 5/005
9,901,188 B2 * 2/2018 Murphy ..... A47F 1/126
10,123,637 B1 * 11/2018 DeSena ..... A47F 5/0068
11,540,628 B2 * 1/2023 Brück ..... G08B 13/1436
11,627,819 B1 * 4/2023 Fink ..... A47F 1/12 211/59.3
2003/0066811 A1 * 4/2003 Dimattio ..... A47F 5/005 211/184
2004/0060944 A1 * 4/2004 Gervasi ..... A47F 3/002 221/263
2005/0189369 A1 9/2005 Vlastakis et al.
2011/0089125 A1 * 4/2011 Roeske ..... B65D 25/10 211/74
2012/0048817 A1 * 3/2012 Green ..... A47F 5/0068 211/59.3
2012/0103922 A1 * 5/2012 Bird ..... A47F 1/126 211/59.3
2012/0228242 A1 * 9/2012 Vogler ..... A47F 1/06 211/59.3
2020/0273303 A1 * 8/2020 Ewing ..... A47F 3/002
2022/0369831 A1 * 11/2022 Bruegmann ..... A47F 5/0068
2023/0172372 A1 6/2023 Hua
2023/0233000 A1 7/2023 Welsh et al.

* cited by examiner

THEFT DETERRENT SLIDE DOWN DOOR ASSEMBLY FOR A MERCHANDISE DISPLAY

BACKGROUND OF THE INVENTION

In self-service retail establishments, such as drug stores, grocery stores and the like, articles of merchandise are usually displayed for sale on shelves in which the articles are arranged in rows. The merchandise is accessible substantially only from the front of each shelf.

A growing problem for retail stores is theft of high value inventory directly from the shelves. Thieves target retail stores to sweep shelves of valuable products by quickly removing as much of the products as possible. They then exit the store with the products before store personnel or law enforcement have an opportunity to react. This is particularly a problem with high-value goods.

Retailers are constantly challenged to balance the needs of legitimate access by consumers to high theft items, with measures to minimize the incidence of theft.

Because theft has become so rampant in certain product categories, many retail stores are taking the products off the shelves and placing them behind the counter or under lock and key. Customers must then request the products in order to make a purchase. This requires additional labor costs to provide individual service to customers. This is in addition to the limited shelf space behind the counter.

A need therefore exists in a retail system to slow suspected thieves down, maintain inventory and alert store staff regarding interest, while also enabling shoppers to examine and purchase products, unencumbered by lock and key solutions. Therefore, a device for dispensing apparatus that minimizes the incidence of product theft is needed.

A variety of devices have been proposed for minimizing such theft, and for alerting store personnel when an item is removed from a shelf. Examples of such devices are found in U.S. Pat. Nos. 9,451,836; 8,973,765; 7,641,072; 7,182,209; 7,032,761; 6,802,146; 6,470,611; 5,249,855; and 4,682,825, as well as U.S. Patent Publication Nos. 2023/0233000; 2023/0172372; 2005/0189369; and 20040060944.

These devices, however, have various disadvantages, from requiring a row in a shelf to be left blank, to the pivoting nature of the blocking doors for the rows of products.

SUMMARY OF THE INVENTION

Accordingly, it is an object of the present invention to provide a theft deterrent slide down door assembly for a merchandise display that overcomes the aforementioned problems.

It is another object of the present invention to provide a theft deterrent slide down door assembly for a merchandise display that deters, or at least slows down, theft of merchandise from retail shelves.

It is yet another object of the present invention to provide a theft deterrent slide down door assembly for a merchandise display that provides an audible alarm or noise each time a door is moved to an unblocking position to allow access to the merchandise on the shelf.

It is a further object of the present invention to provide a theft deterrent slide down door assembly for a merchandise display that automatically returns the door to its blocking position when released.

It is a still further object of the present invention to provide a theft deterrent slide down door assembly for a merchandise display that restricts return of the door to the blocking position in a slower, timely manner.

It is a yet further object of the present invention to provide a theft deterrent slide down door assembly for a merchandise display that is relatively inexpensive to manufacture and use.

In accordance with an aspect of the present invention, a theft deterrent slide down door assembly for a merchandise display, includes a door mounting assembly mounted to a front of a shelf adapted to display merchandise thereon in rows for purchase by a consumer; and a door slidably mounted to the door mounting assembly for movement between a first position in blocking relation to removal of the merchandise from the shelf and a second position out of the blocking relation to permit removal of an item of merchandise from the shelf upon application of an external force to the door.

The door mounting assembly includes a holder mount mounted to the front of the shelf, and a return arrangement connected between the holder mount and the door for automatically returning the door to the first position upon release of the force. Preferably, the return arrangement includes a wound spring positioned in the holder mount and having a free end connected with the door, such that movement of the door to the second position causes the spring to unwind, and upon release of the external force, the spring automatically moves the door back to the first position.

A control arrangement is connected between the holder mount and the door for slowing down sliding movement of the door when the door is automatically returned to the first position. The control arrangement also includes structure for producing an audible sound during sliding movement of the door. Preferably, the control arrangement includes a rack having a plurality of teeth on one of the holder mount and the door; and a pawl on the other of the holder mount and the door, in engagement with the teeth.

The door mounting assembly includes a holder mount mounted to the front of the shelf, and the holder mount includes at least one vertically oriented slot and the door includes at least one vertically oriented projection slidably fit within the at least one vertically oriented slot. Preferably, each projection has an L-shape, and the holder mount includes at least one blocking wall that prevents escape of the at least one vertically oriented projection while permitting sliding thereof in the at least one vertically oriented slot.

Each door includes an upper abutment and a lower abutment on a rear surface thereof for providing limits to sliding movement of the door relative to the holder mount.

Further, an adjustable securing arrangement is connected with the holder mount for mounting the holder mount to the front of the shelf.

The door also includes a finger hold on a front surface thereof for applying the external force to the door.

The above and other features of the invention will become readily apparent from the following detailed description thereof which is to be read in connection with the accompanying drawings.

DETAILED DESCRIPTION

Figure 1:
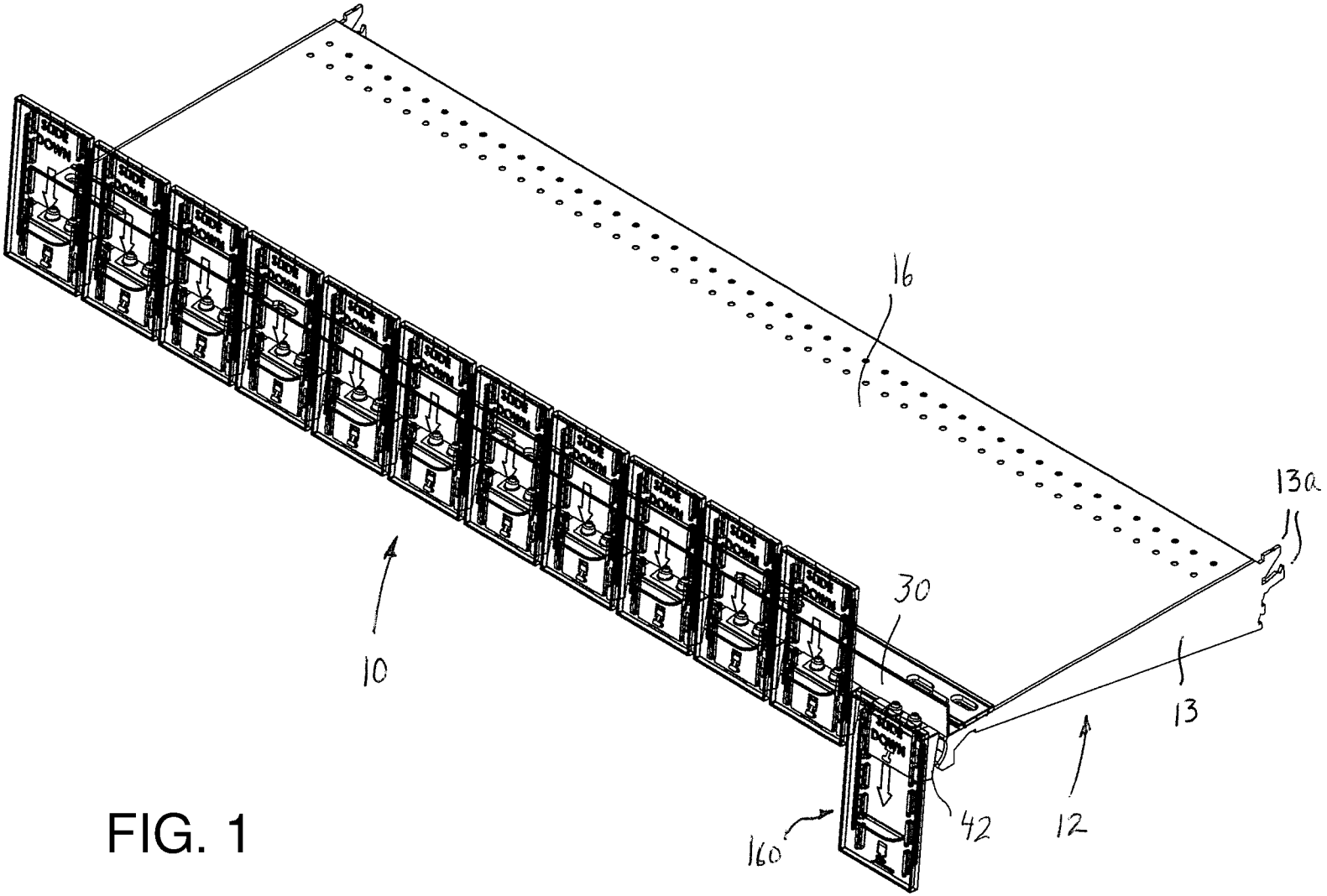
FIG. 1 is a front, top perspective view of a theft deterrent slide down door assembly for a merchandise display according to the present invention.
Figure 2:
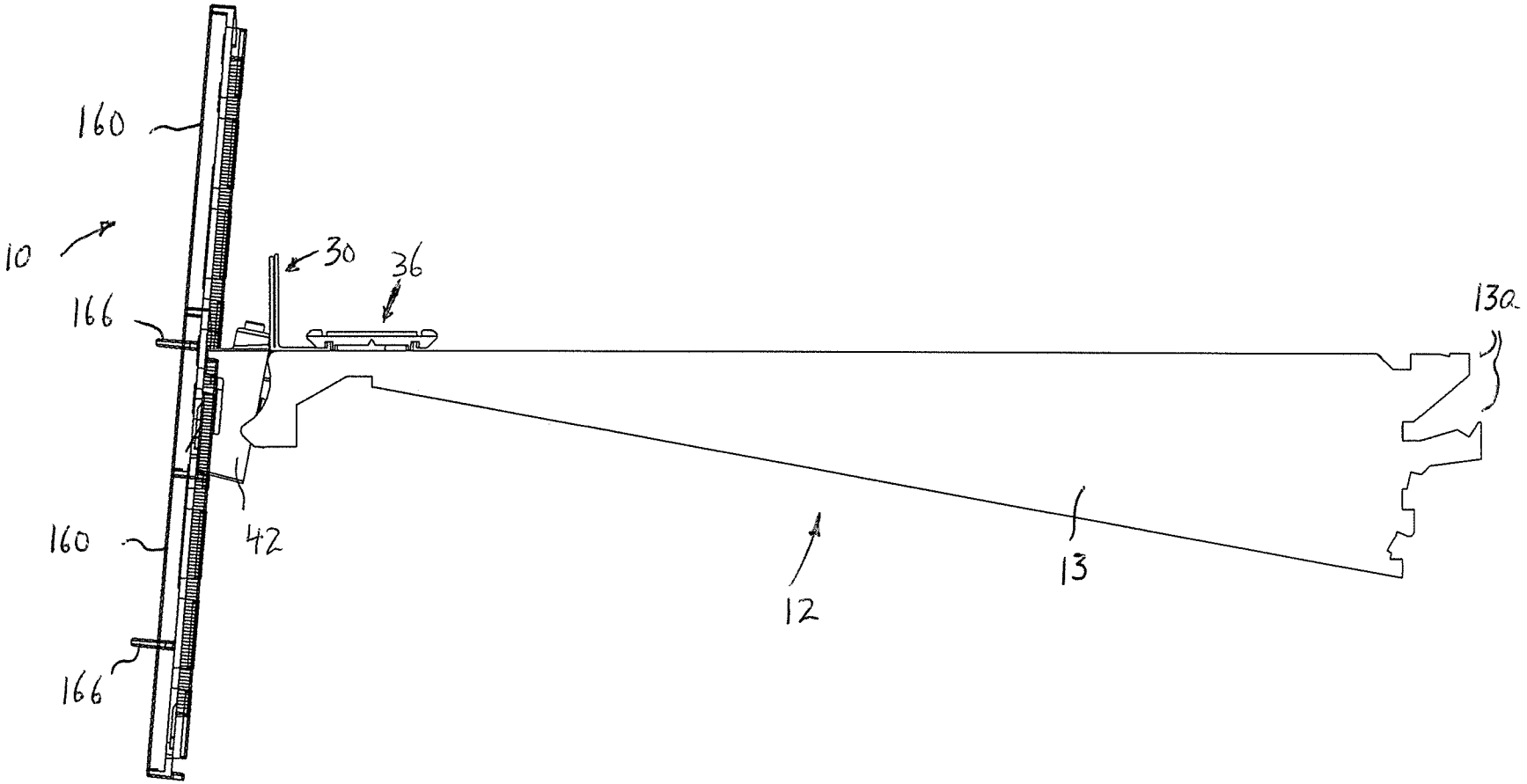
FIG. 2 is a side elevational view of the theft deterrent slide down door assembly of FIG. 1 for a merchandise display.
Figure 3:
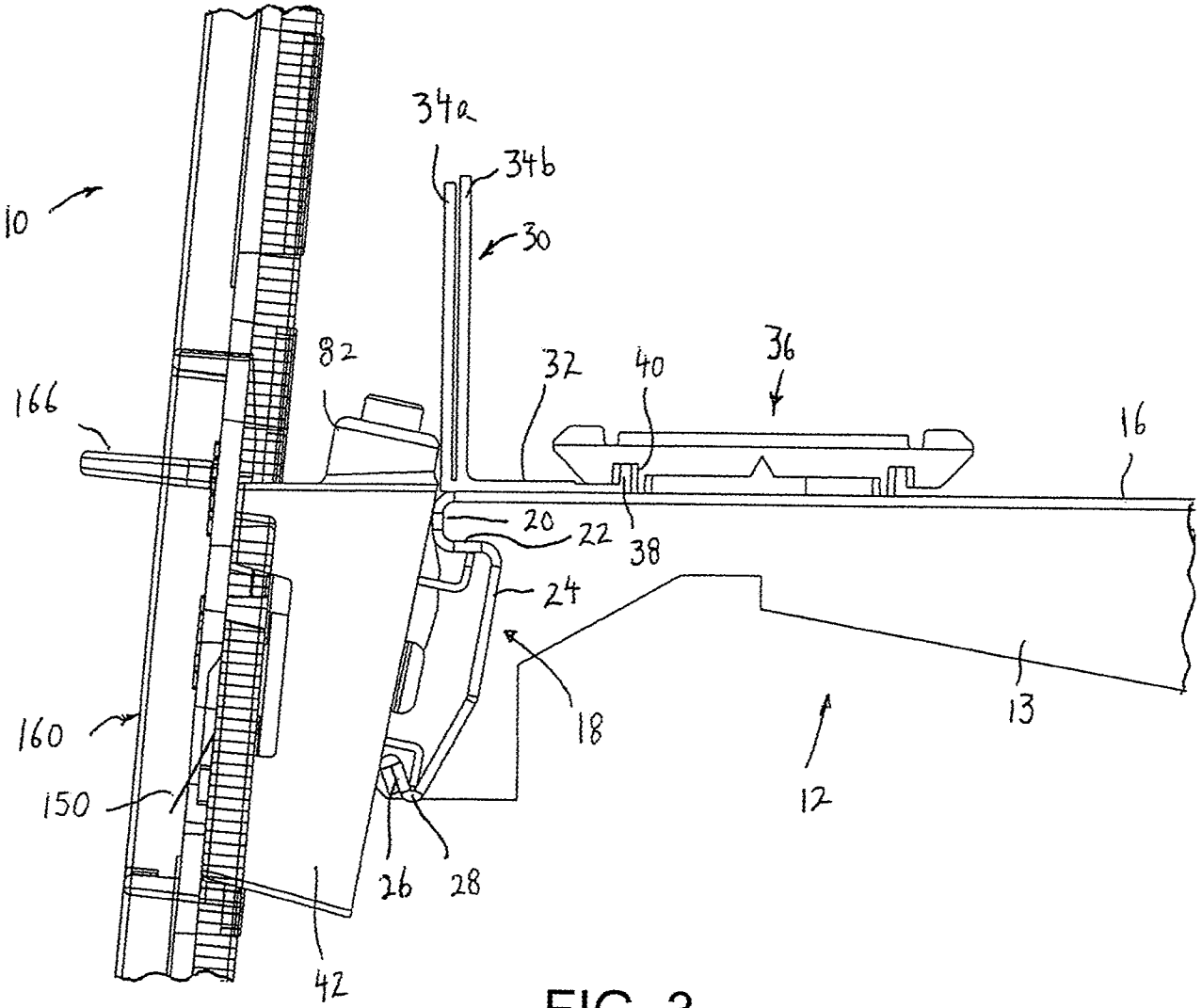
FIG. 3 is an enlarged side elevational view of a portion of the theft deterrent slide down door assembly of FIG. 2, with a side wall of the shelf removed to show the attachment of the theft deterrent slide down door assembly to the shelf.
Figure 5:
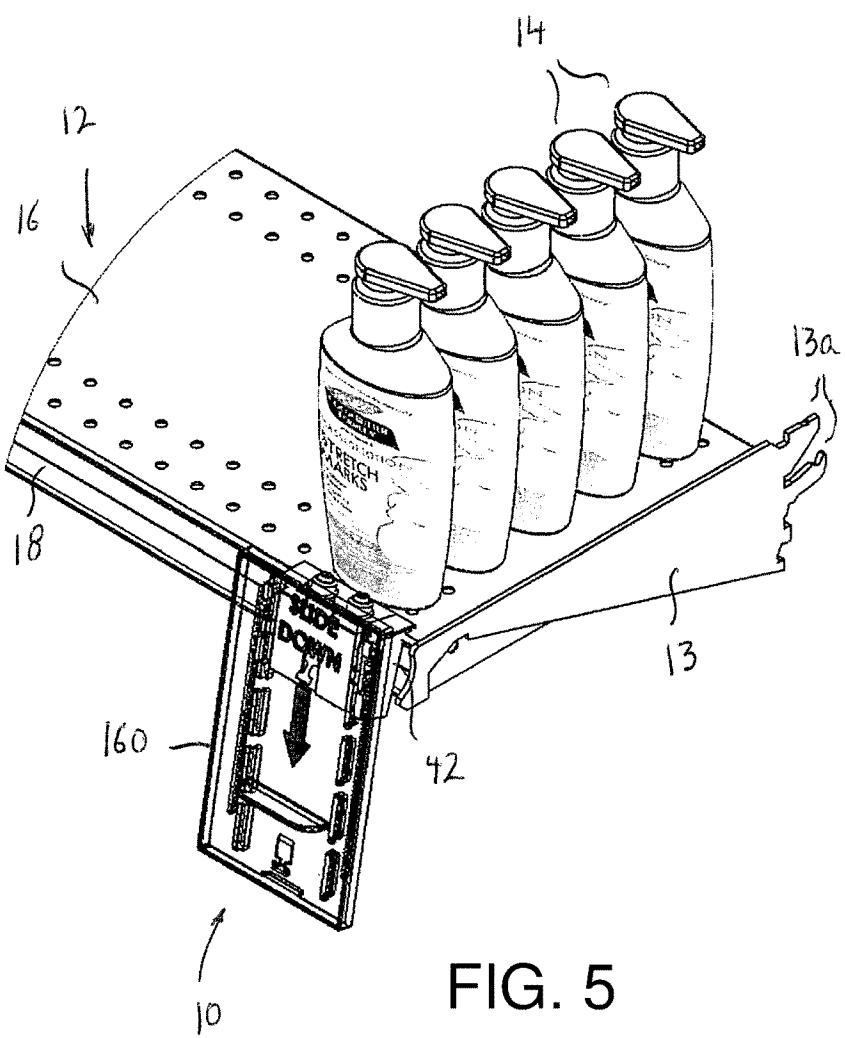
FIG. 5 is a front, top perspective view of a portion of the theft deterrent slide down door assembly of FIG. 1, showing one slide down door out of blocking relation to a row of merchandise on the shelf.
Figure 4:
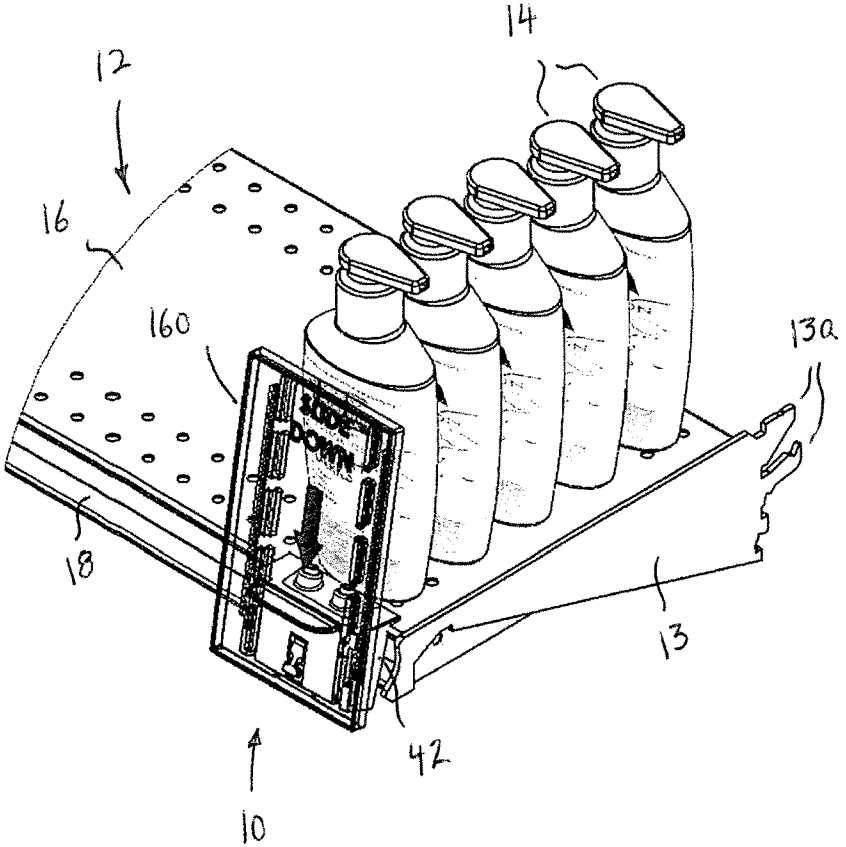
FIG. 4 is a front, top perspective view of a portion of the theft deterrent slide down door assembly of FIG. 1, showing one slide down door in blocking relation to a row of merchandise on the shelf.

Referring to the drawings, and initially to FIGS. 1-3, a theft deterrent slide down door assembly 10 according to the present invention is disclosed for attachment to a merchandise display shelf 12 for holding rows of products 14 in a store.

Stores conventionally display items to be sold on shelves throughout the store. Shelf 12 is either fixed and immovable to a wall or other structure, or is removably fixed in an non-movable manner to a wall or other structure, for example, by hooks 13*a* extending rearwardly from the rear edges of side walls 13 of shelf 12. As such, the position of shelf 12 can be moved to a different fixed, non-movable position.

As shown in FIGS. 1-5, a shelf 12 that can be used with the present invention includes a rectangular planar support 16 having a downwardly turned front edge plate section 18. Preferably, rectangular plate support 16 is inclined downwardly from the rear end to the front end thereof in order to feed the products 14 by gravity feed, although the present invention is not limited thereto. For example, rectangular planar support 16 can be arranged in a perfectly horizontal manner without any incline, and in such case, a spring loaded pusher (not shown) can push products 14 toward the front end of rectangular planar support 16. Side walls 13 are connected to opposite sides of rectangular plate support 16.

As shown best in FIG. 3, front edge plate section 18 includes a short downwardly extending wall 20 that extends downwardly from the front edge of rectangular planar support 16. A short rearwardly extending wall 22 extends rearwardly from the lower end of downwardly extending wall 20. A slightly forwardly inclined wall 24 extends downwardly and forwardly from the rear end of rearwardly extending wall 22. Forwardly inclined wall 24 may be formed in a slightly concave manner. Finally, front edge plate section 18 includes a capture wall 26 extending upwardly and forwardly from the lower end of forwardly inclined wall 24. The inner intersection of forwardly inclined wall 24 and capture wall 26 constitutes a capture corner 28.

Preferably, as shown best in FIG. 3, although not essential to the present invention, an L-shaped clear thermoplastic extrusion 30 can be secured to the front end of rectangular planar support 16. L-shaped extrusion 30 can, for example, be made of a thermoplastic material sold under the trademark STYROLUX. L-shaped extrusion 30 includes a rectangular securing wall 32 that extends the length of shelf 12 and seats flush on rectangular planar support 16 at the front end thereof. Two parallel, slightly spaced apart vertical walls 34*a* and 34*b* extend upwardly from the front edge of securing wall 32, and also extend the length of shelf 12. Securing wall 32 is held down on rectangular planar support 16 by a securing member 36 which can be secured to rectangular planar support 16 by screws or the like (not shown). For example, a short vertical wall 38 can extend upwardly from the rear edge of securing wall 32 and be fit within a recess 40 at the underside of securing member 36 and extending the length of shelf 12. It will be appreciated, however, that any other securing means can be used.

With this arrangement, a price tag and/or UPC code can be placed between vertical walls 34*a* and 34*b* to provide information to the consumer regarding the products 14 held in that particular row on shelf 12. In addition, vertical walls 34*a* and 34*b* can function as a stop for the forwardmost product 14 in each row on the shelf 12.

Figure 6:
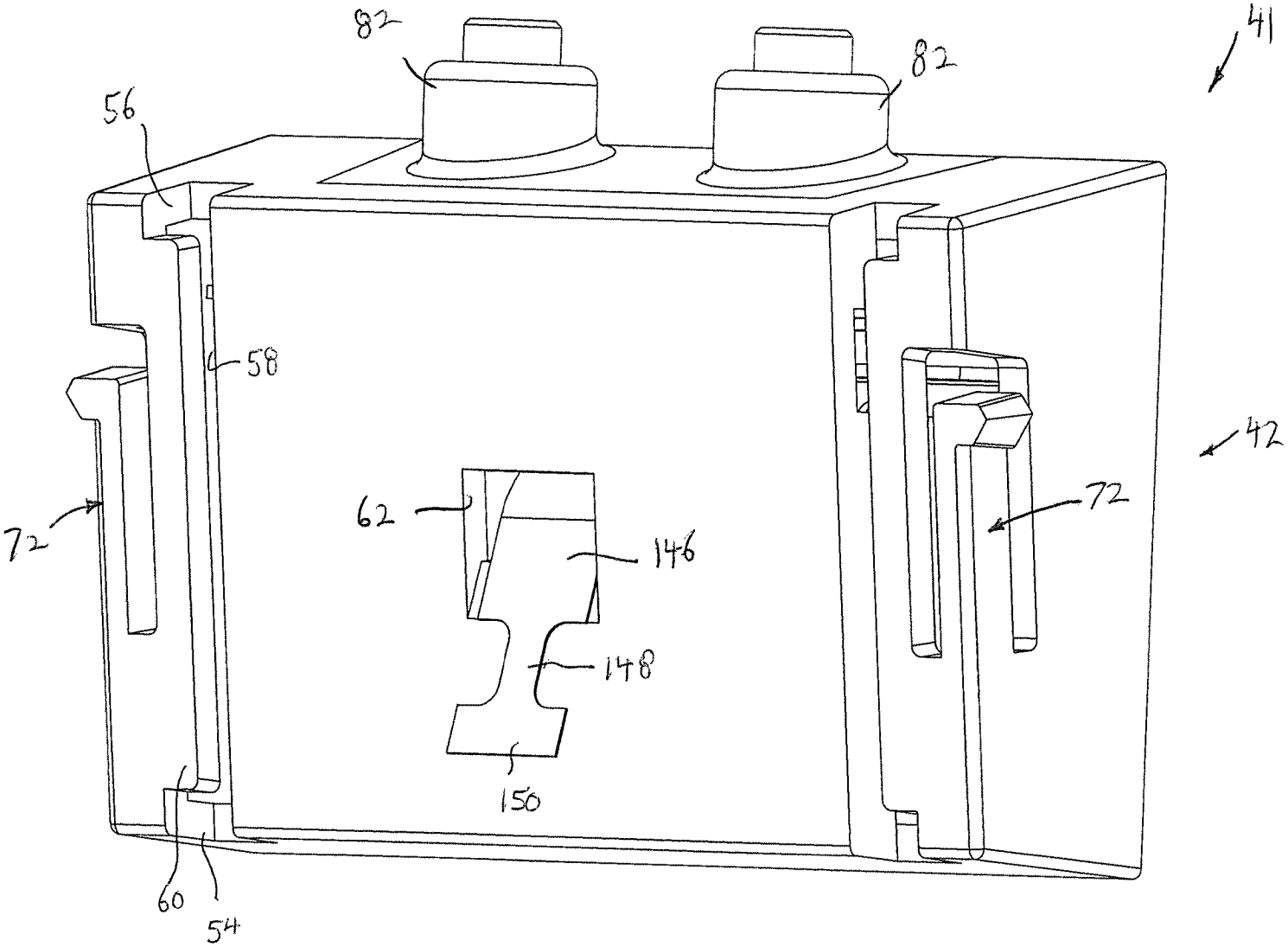
FIG. 6 is a front perspective view of one door mounting assembly for slidably holding one slide down door.
Figure 7:
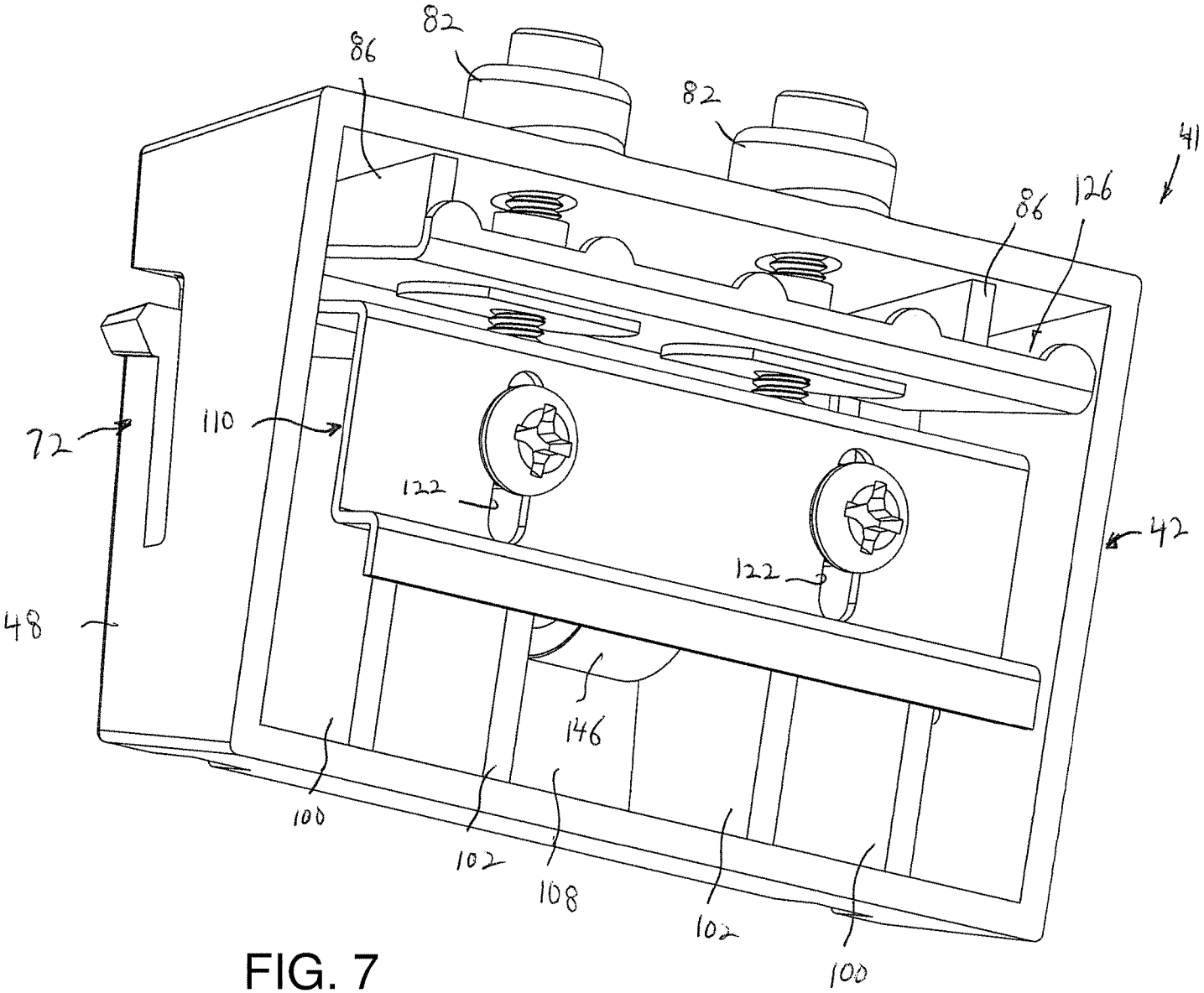
FIG. 7 is a rear perspective view of the door mounting assembly of FIG. 6.
Figure 8:
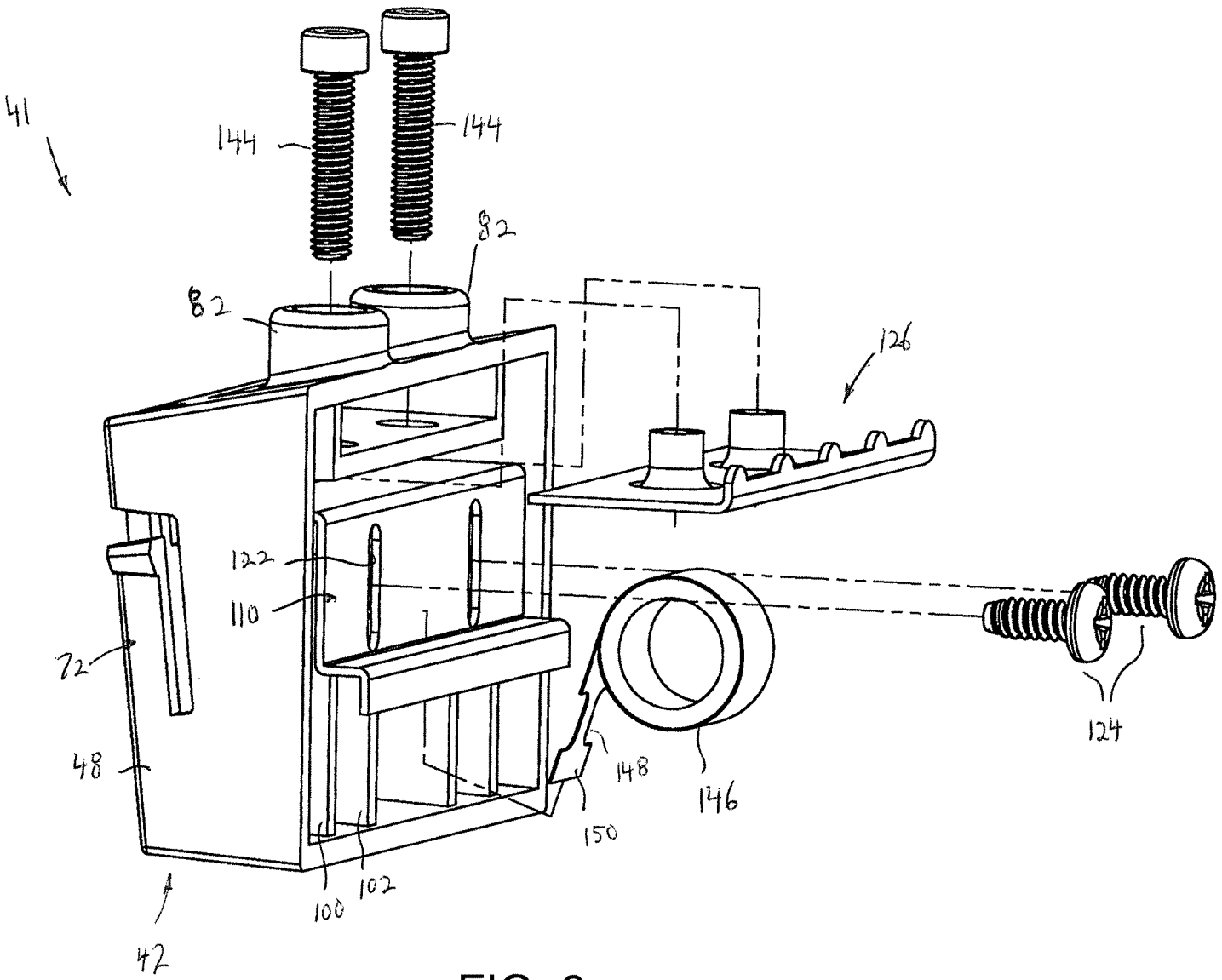
FIG. 8 is an exploded perspective view of the door mounting assembly of FIG. 6.
Figure 9:
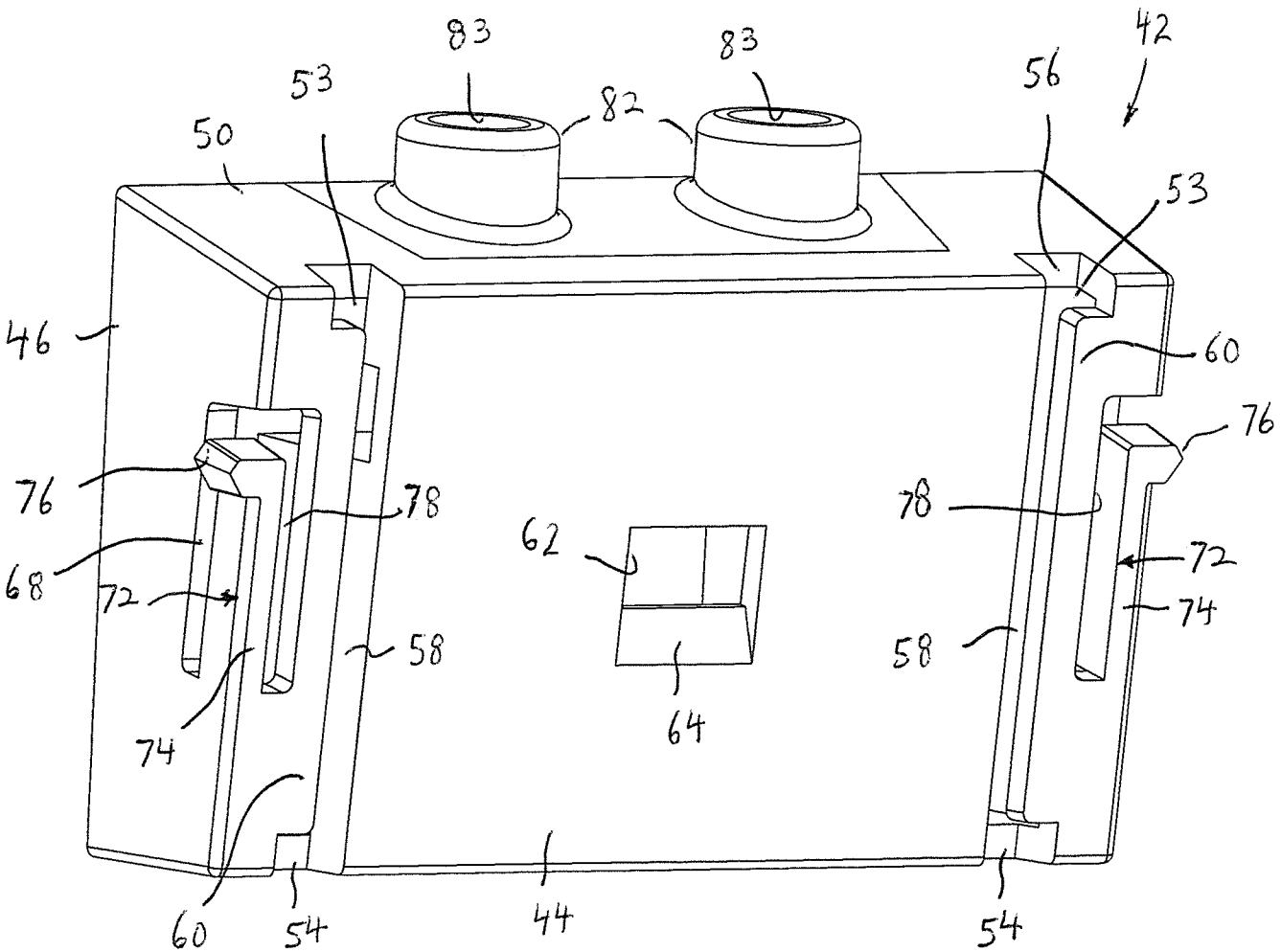
FIG. 9 is a front perspective view of the holder mount of the door mounting assembly of FIG. 6.
Figure 10:
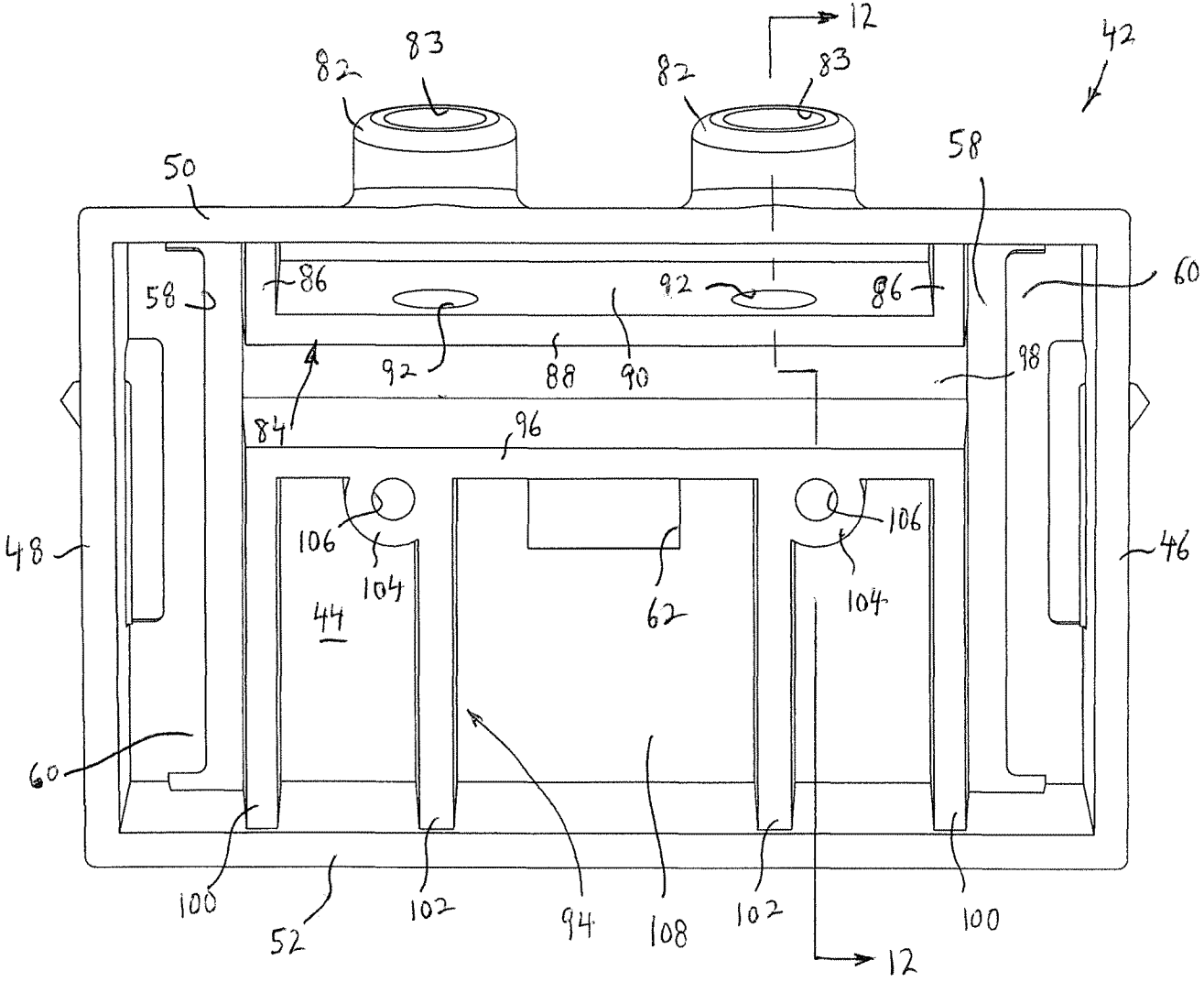
FIG. 10 is a rear bottom perspective view of the holder mount of the door mounting assembly of FIG. 6.
Figure 11:
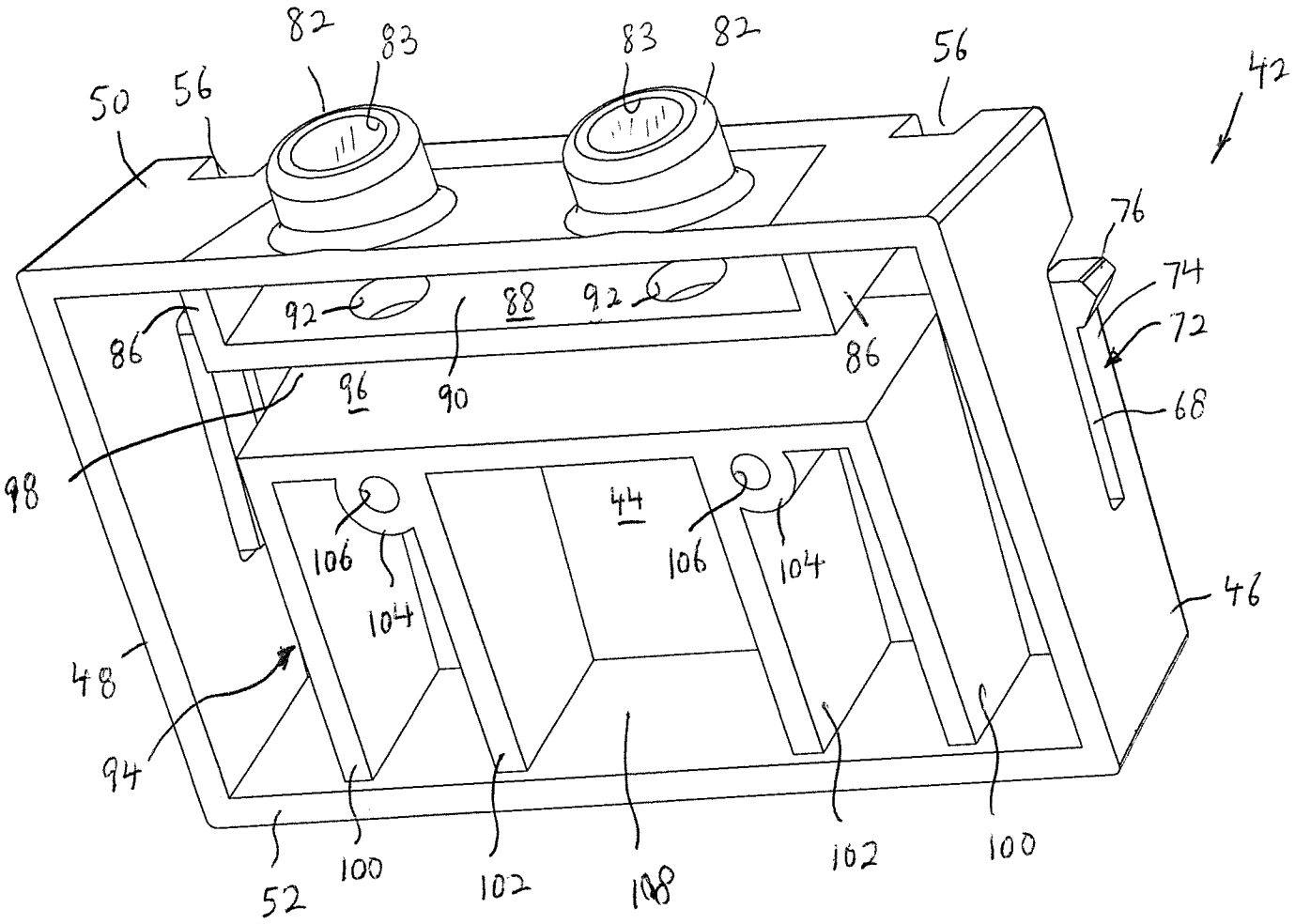
FIG. 11 is a rear top perspective view of the holder mount of the door mounting assembly of FIG. 6.
Figure 12:
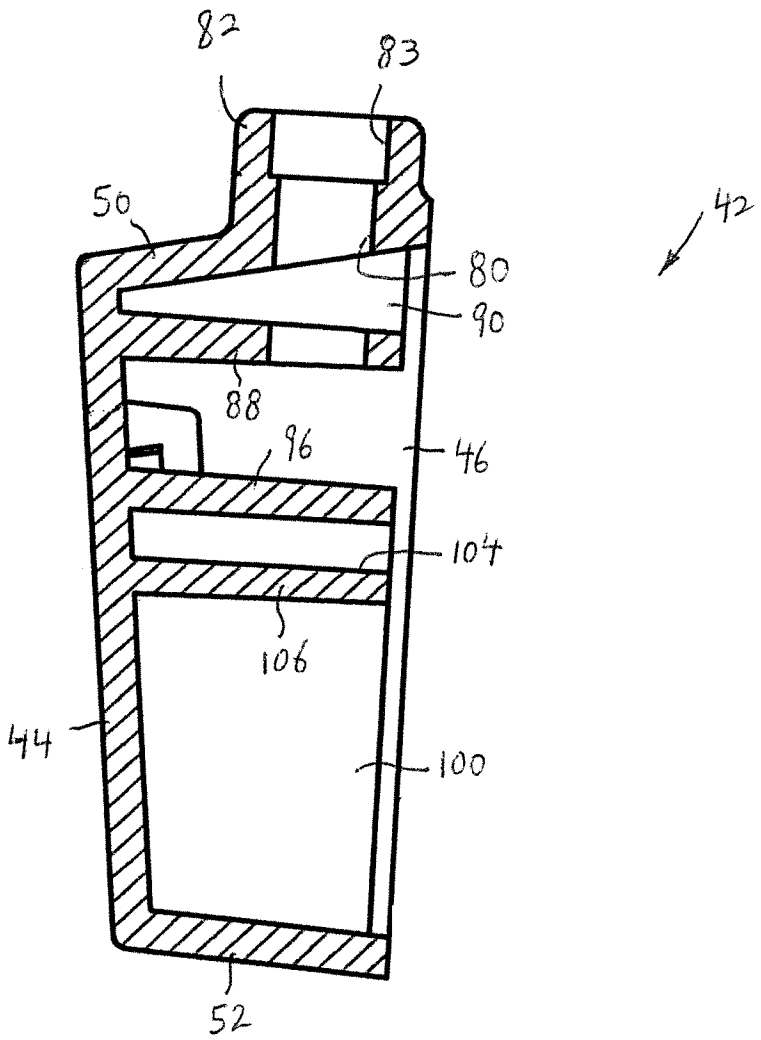
FIG. 12 is a cross-sectional view of the holder mount of the door mounting assembly of FIG. 10, taken along line 12-12 thereof.
Figure 13:
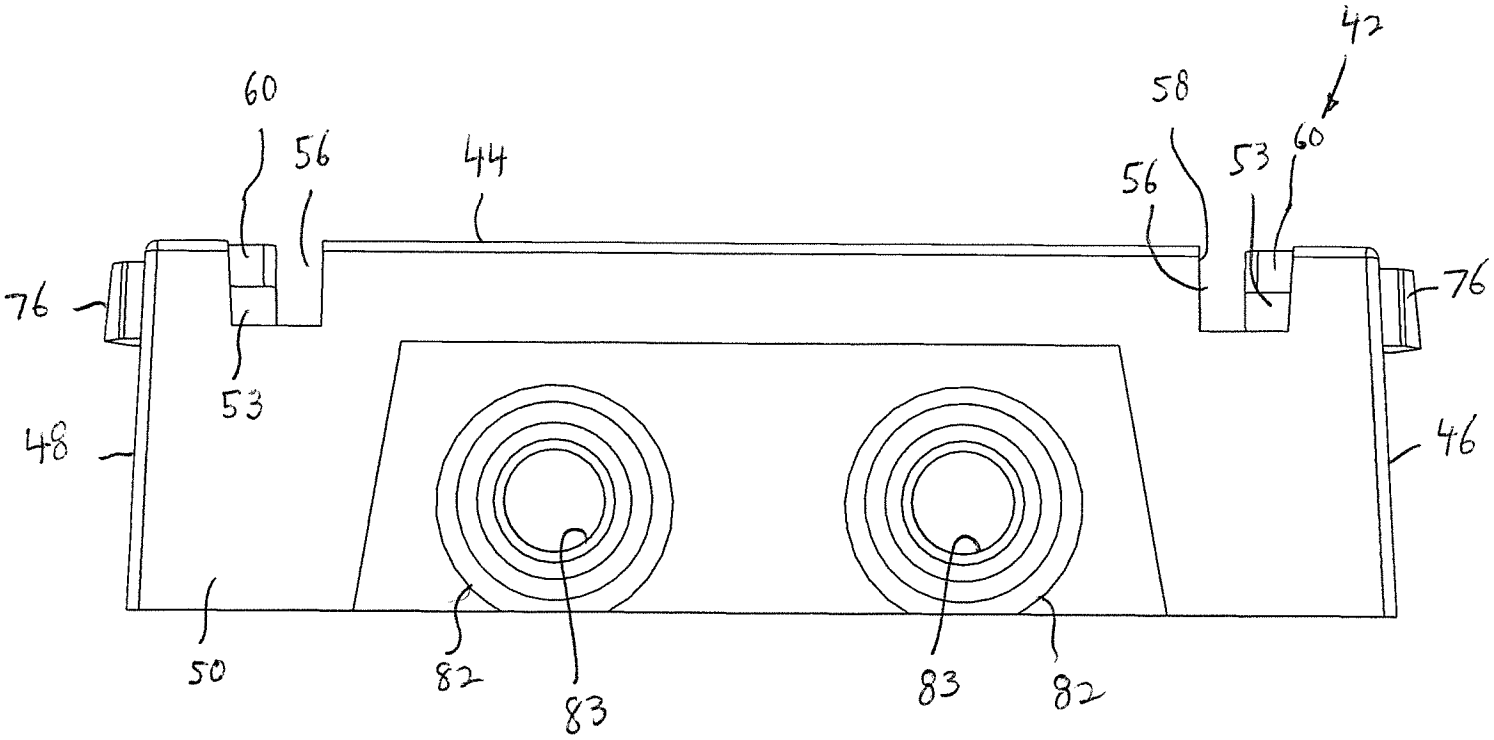
FIG. 13 is a top plan view of the holder mount of the door mounting assembly of FIG. 6.
Figure 14:
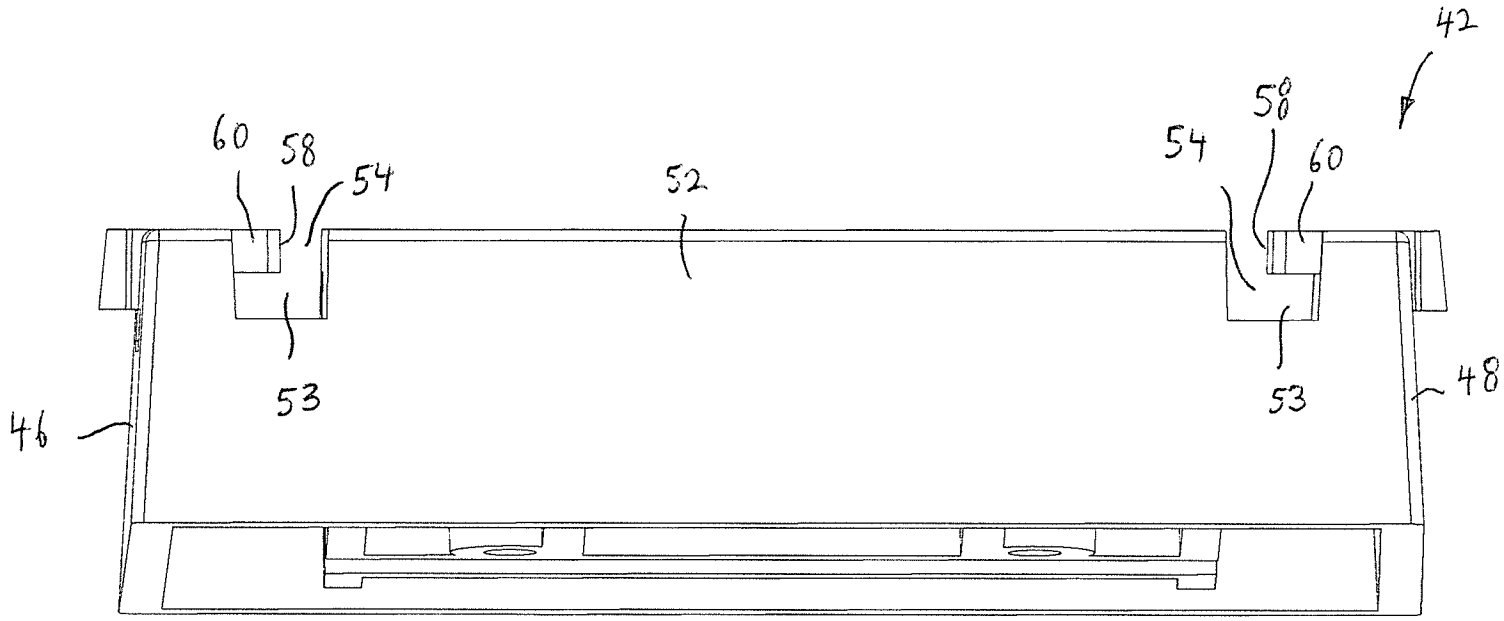
FIG. 14 is a bottom plan view of the holder mount of the door mounting assembly of FIG. 6.
Figure 15:
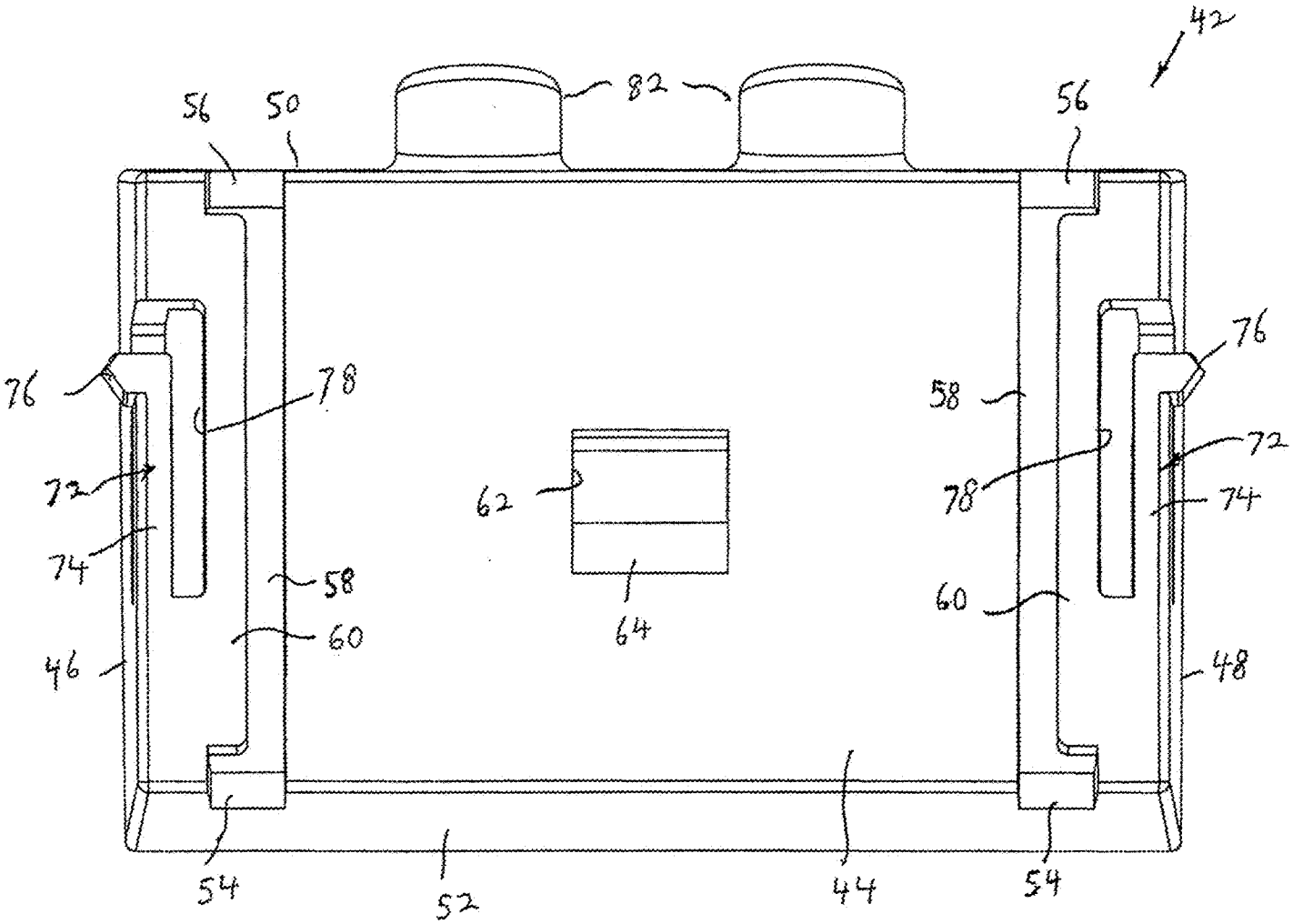
FIG. 15 is a front elevational view of the holder mount of the door mounting assembly of FIG. 6.
Figure 16:
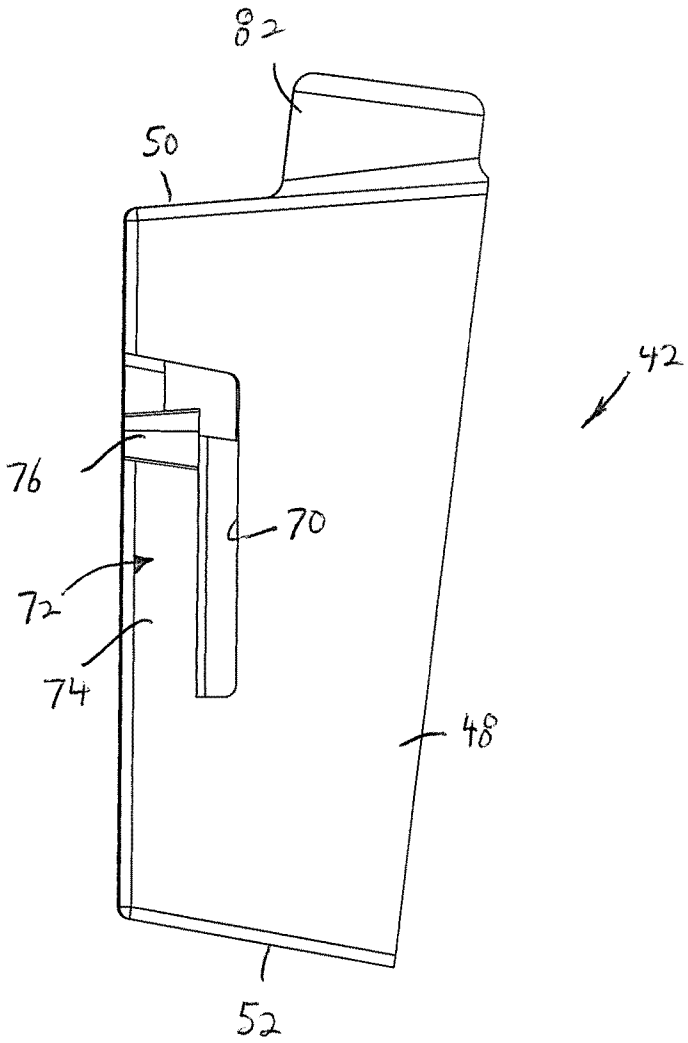
FIG. 16 is a right side elevational view of the holder mount of the door mounting assembly of FIG. 6.

Theft deterrent slide down door assembly 10 includes a door mounting assembly 41 for mounting a slidable door thereto. Door mounting assembly 41, as best shown in FIGS. 6-8, includes a holder mount 42 which is removably connected with shelf 12.

Specifically, as shown best in FIGS. 6-16, holder mount 42 is defined by a housing including a front wall 44 opposite side walls 46 and 48, a top wall 50 and a bottom wall 52, with the rear of holder mount 42 being open.

Front wall 44 is a rectangular planar wall and an elongated vertical opening 53 is formed behind front wall 44 at each side of holder mount 42, spaced inwardly from side walls 46 and 48. Elongated vertical opening 53 extends from an entry opening 54 at the lower end of holder mount 42 and which is formed by cutting out a portion of front wall 44 and bottom wall 52, up to an exit opening 56 at the upper end of holder mount 42 and which is formed by cutting out a portion of front wall 44 and top wall 50. A narrow vertical slot 58 is formed in front wall 44 in open communication with each elongated vertical opening 53, and is narrower in the widthwise direction than each vertical opening 53. As a result, a vertical blocking wall 60 extending from entry opening 54 to exit opening 56, is formed in front of each elongated vertical opening 53.

A generally square central opening 62 is provided centrally of front wall 44, and is partially closed at its lower end by an inclined wall 64 that is inclined forwardly from its upper end to its lower end.

In addition, front wall 44 and each side wall 46 and 48 are cut away to define recesses 68 and 70, respectively, as well as a pawl 72. Specifically, pawl 72 includes a cantilevered arm 74 extending upwardly from the lower end of each recess 68, 70 of front wall 44, with a catch 76 extending outwardly from the upper end of each cantilevered arm 74. The inner surface of each cantilevered arm 74 is spaced from front wall 44 to define a gap 78. In this manner, each cantilevered arm 74 can be biased inwardly by an external force, and when the external force is removed, cantilevered arm 74 springs back to its original position shown in FIG. 9.

Top wall 50 includes two spaced apart circular openings 80, each surrounded by an annular boss 82 extending upwardly from top wall 50 having a central bore 83 in axial alignment with and in open communication with a respective circular opening 80.

A U-shaped shelf 84 extends downwardly from the underside of top wall 50. Specifically, U-shaped shelf 84 includes two spaced apart side walls 86 connected at their front ends to the rear surface of front wall 44 and at their upper ends to the underside of top wall 50, with the lower ends of side walls 86 connected together by a planar lower connecting wall 88. Side walls 86 are spaced from side walls 46 and 48. As such, lower wall 88 is in parallel, spaced apart relation to top wall 50 with a gap 90 therebetween. Two circular openings 92 are provided in lower connecting wall 88 in axial alignment with her respective circular openings 80.

Lastly, a lower table 94 is provided below U-shaped shelf 84. Lower table 94 includes a planar upper wall 96 in parallel, spaced apart relation below connecting wall 88 so as to define a gap 98 therebetween, and connected at the front edge thereof to the inner surface of front wall 44. The opposite ends of planar upper wall 96 are supported by outer side supporting walls 100 connected therewith, and also connected to the inner surface of front wall 44 at their front ends and to the inner surface of bottom wall 52 at their lower ends. Outer side supporting walls 100 are spaced away from side walls 46 and 48. In addition, two inner side supporting walls 102 also support planar upper wall 96. Inner side supporting walls 102 are provided in parallel relation to outer side supporting walls 100, but spaced inwardly therefrom. Inner side supporting walls 102 are connected at their upper ends to planar upper wall 96, at their lower ends to the inner surface of bottom wall 52, and at their front ends to the inner surface of front wall 44. A part annular boss 104 is provided at the intersection of the upper end of each inner side supporting wall 102 and planar upper wall 96, each having a threaded opening 106 therein. It will be appreciated that an open chamber 108 is defined between front wall 44, bottom wall 52 and inner side supporting wall 102, with open chamber 108 being accessible through the rear of holder mount 42 and being in open communication with central opening 62 in front wall 44.

Figure 17:
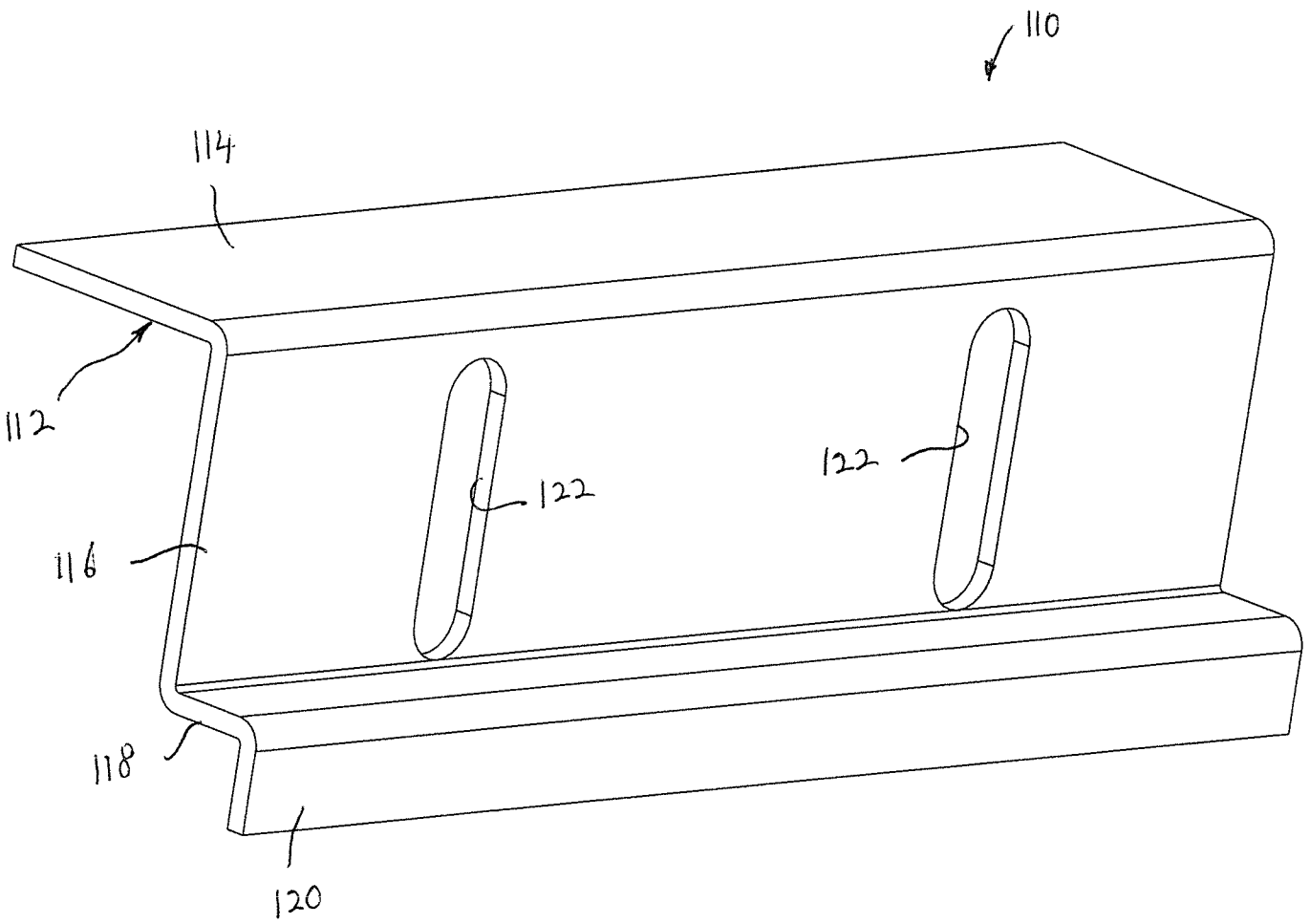
FIG. 17 is a perspective view of the bottom bracket of the door mounting assembly of FIG. 6.
Figure 18:
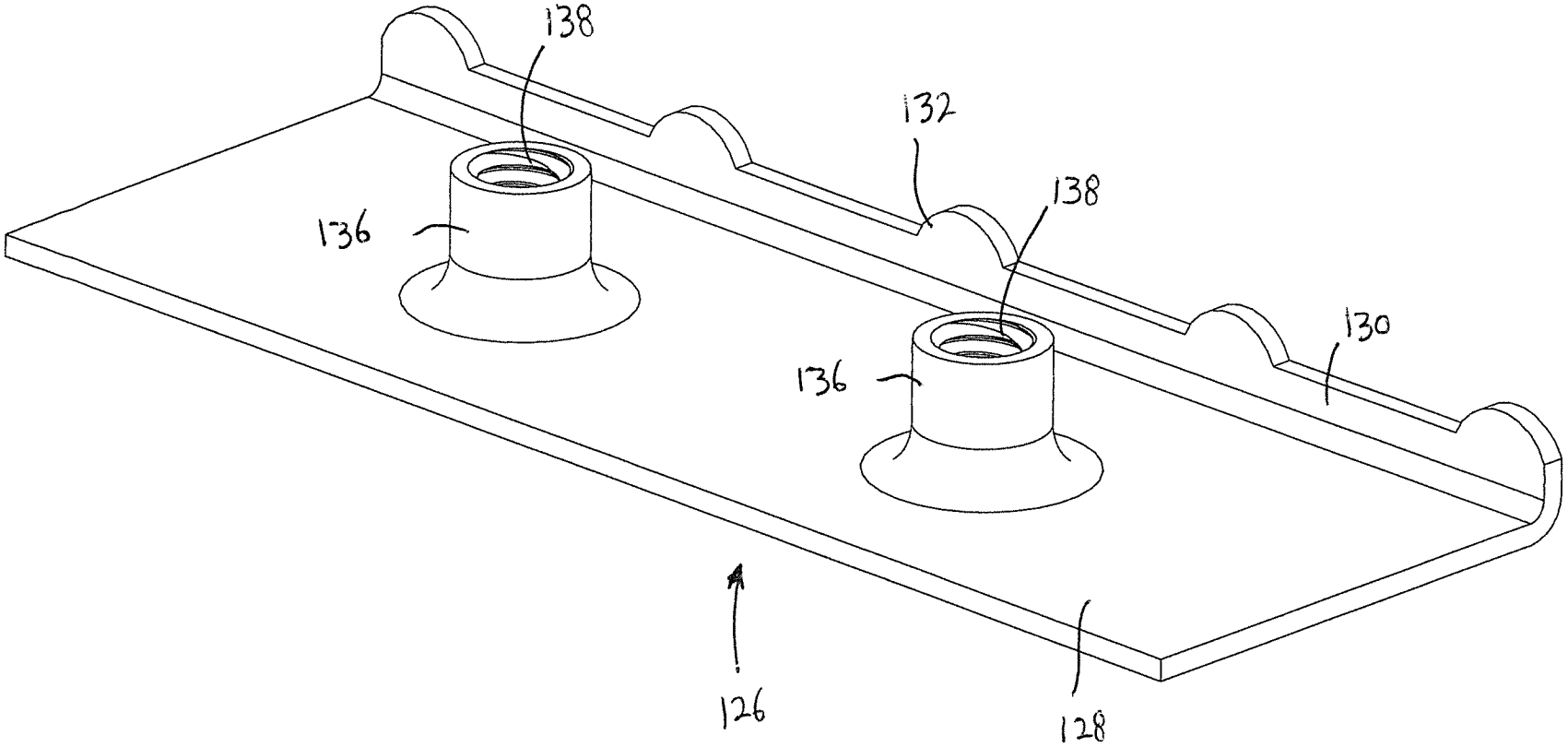
FIG. 18 is a top perspective view of the top bracket of the door mounting assembly of FIG. 6, with threaded bosses welded thereto.
Figure 19:
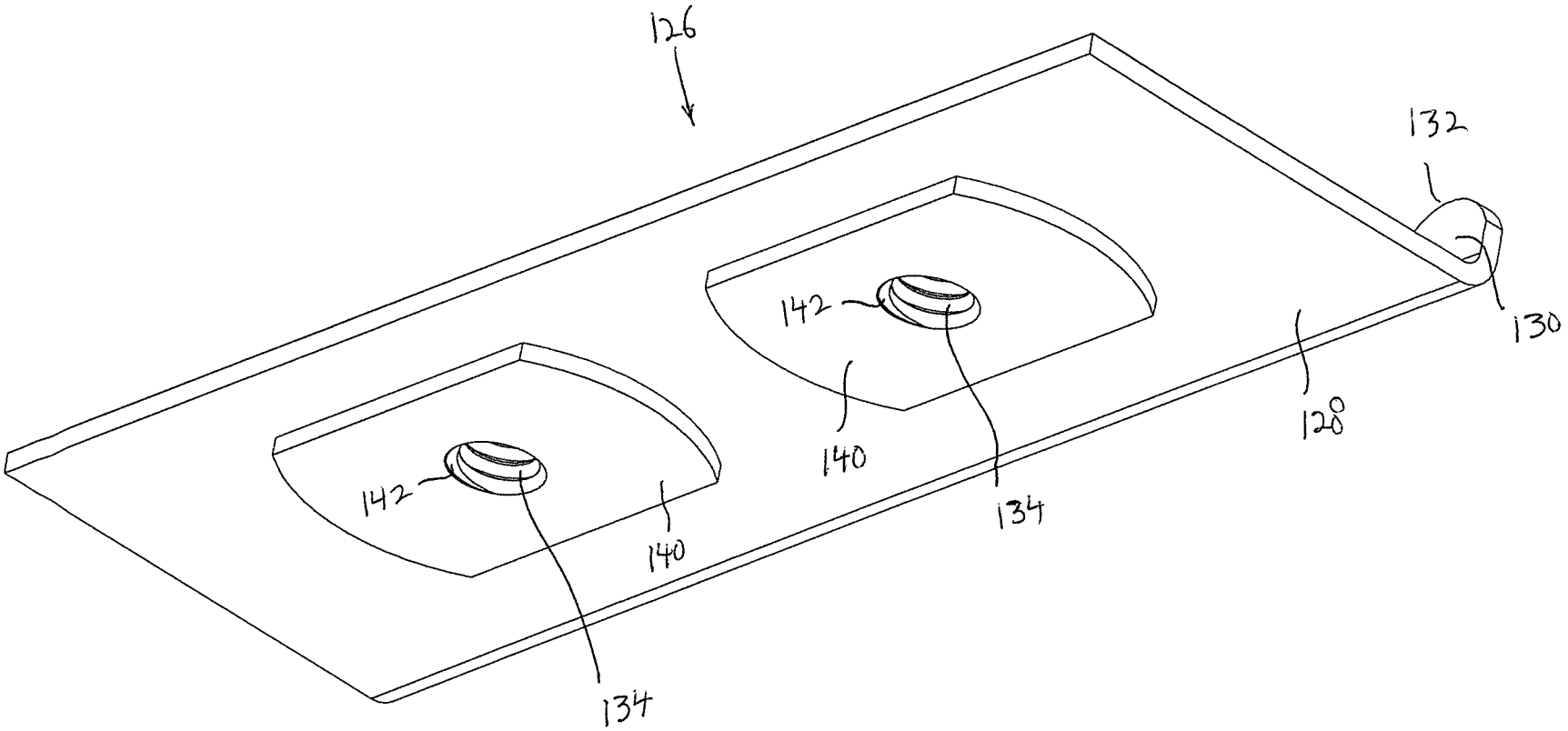
FIG. 19 is a bottom perspective view of the top bracket and welded bosses of FIG. 18.
Figure 20:
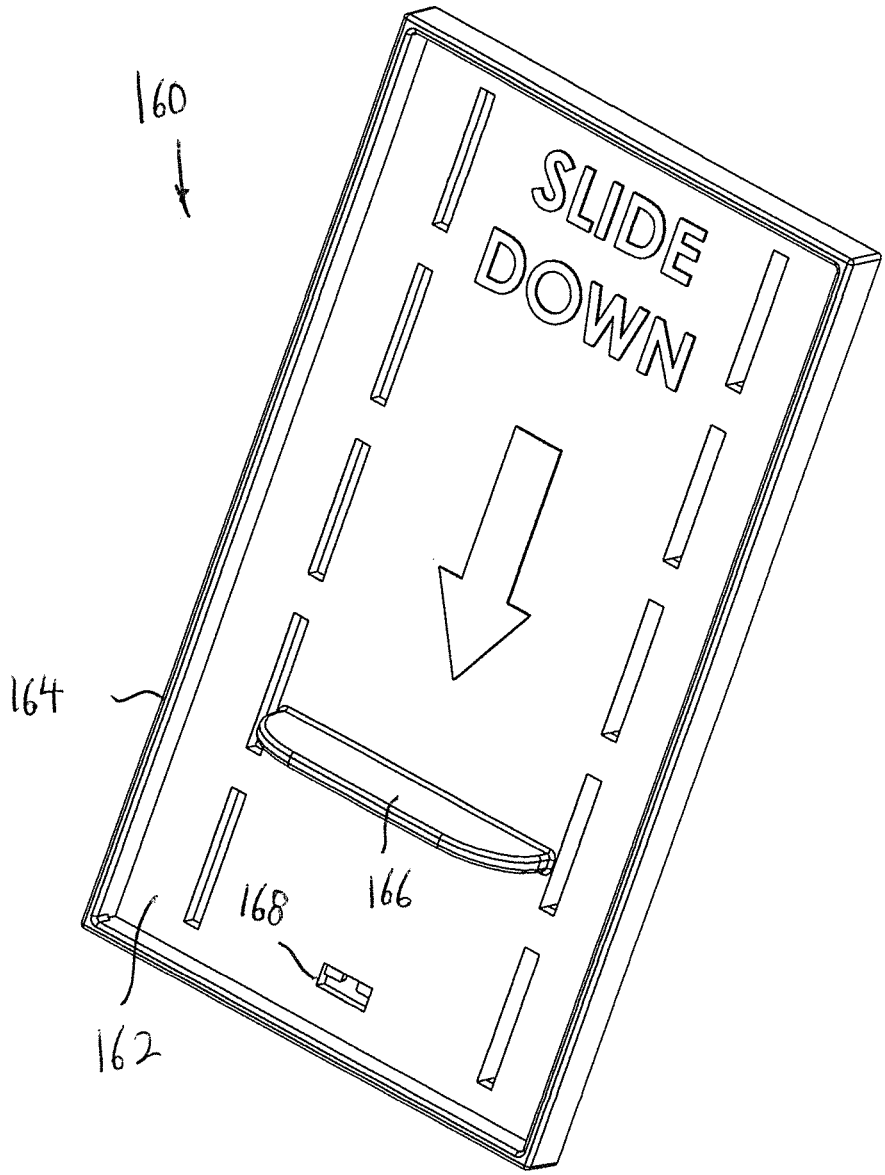
FIG. 20 is a front perspective view of the slide down door of the theft deterrent slide down door assembly of FIG. 1.

In order to removably secure holder mount 42 to shelf 12, a bottom bracket 110, shown in FIGS. 7, 8 and 17, is secured to holder mount 42. Bottom bracket 110 is formed by a bent plate 112 having a rectangular upper horizontal plate section 114, a vertical plate section 116 that extends downwardly from the rear end of upper horizontal plate section 114, a lower horizontal plate section 118 that extends rearwardly and outwardly from the lower end of vertical plate section 116, and a short vertical holding plate section 120 that extends downwardly from the free rear edge of lower horizontal plate section 118. Two parallel, spaced apart vertical slots 122 are provided in vertical plate section 116, in alignment with threaded openings 106.

As shown in FIG. 8, two screws 124 are provided, which extend through vertical slots 122 and are readily received within threaded openings 106 of part annular bosses 104. With this arrangement, bottom bracket 110 is removably secured to holder mount 42 and can be adjusted up and down relative thereto. With this connection, upper horizontal plate section 114 extends into the gap 98 between planar lower connecting wall 88 of U-shaped shelf 84 and planar upper wall 96 of lower table 94.

As shown in FIGS. 7, 8, 18 and 19, an upper bracket 126 is formed by a rectangular horizontal plate 128 having a short upturned bent section 130 extending upwardly at a lengthwise edge thereof therefrom and having a scalloped upper edge 132. Two spaced apart circular openings 134 are formed in horizontal plate 128 with the same spacing as circular openings 80. Two annular bosses 136 are provided, each having an internal threaded opening 138 extending entirely therethrough, and with a welding plate 140 secured to the lower end thereof. Each welding plate 140 has a threaded opening 142 in axial alignment with the respective threaded opening 138. Each annular boss 136 is inserted upwardly through a circular opening 134, until its welding plate abuts against the lower surface of horizontal plate 128, and is welded to horizontal plate 128 thereat.

Upper bracket 126 is inserted into the gap between planar lower connecting wall 88 of U-shaped shelf 84 and upper horizontal plate section 114 of bottom bracket 110.

Two bolts 144 are provided, each extending through a respective annular boss 82, circular opening 80 and circular opening 92, and threadedly received in internal threaded opening 138 and threaded opening 142. As a result, by rotating bolts 144, upper bracket 126 can be moved up and down relative to holder mount 42.

As shown in FIG. 3, with this arrangement, short vertical holding plate section 120 is received in capture corner 28, and then bolts 144 are rotated until scalloped upper edge 132 tightly engages with the lower surface of short rearwardly extending wall 22 to releasably hold holder mount 42 to shelf 12. Preferably, with this arrangement, as shown in FIG. 3, top wall 50 of holder mount 42 is coplanar with rectangular planar support 16 of shelf 12, although the present invention is not limited thereby.

It will be appreciated, however, that any other suitable arrangement can be used for securing holder mount 42 to the front of a shelf 12.

Lastly, a constant force flat wound spring 146 is positioned within open chamber 108, and restrained therein by vertical plate section 116 of bottom bracket 110. Flat wound spring 146 has a narrow neck section 148 spaced slightly from the free end thereof, thereby creating a wider free end section 150. Flat wound spring 146 extends through square central opening 62 of front wall 44, the purpose for which will be understood from the description hereafter.

Theft deterrent slide down door assembly 10 further includes a slide down door 160 which is slidably mounted to holder mount 42. Slide down door 160 includes a generally rectangular, transparent panel 162 made from a plastic material. A peripheral border lip 164 extends forwardly from the outer rectangular edge of transparent panel 162. A finger hold 166 is provided horizontally on the front surface of transparent panel 162, spaced upwardly from the bottom edge thereof.

A small rectangular opening 168 is provided at the lower end of transparent panel 162, centered in the widthwise direction thereof. At the rear side of transparent panel 162, there is a narrower recess 170 in open communication with small rectangular opening 168, with narrower recess 170 opening into a larger rectangular recess 172 at the rear side of transparent panel 162.

Figure 21:
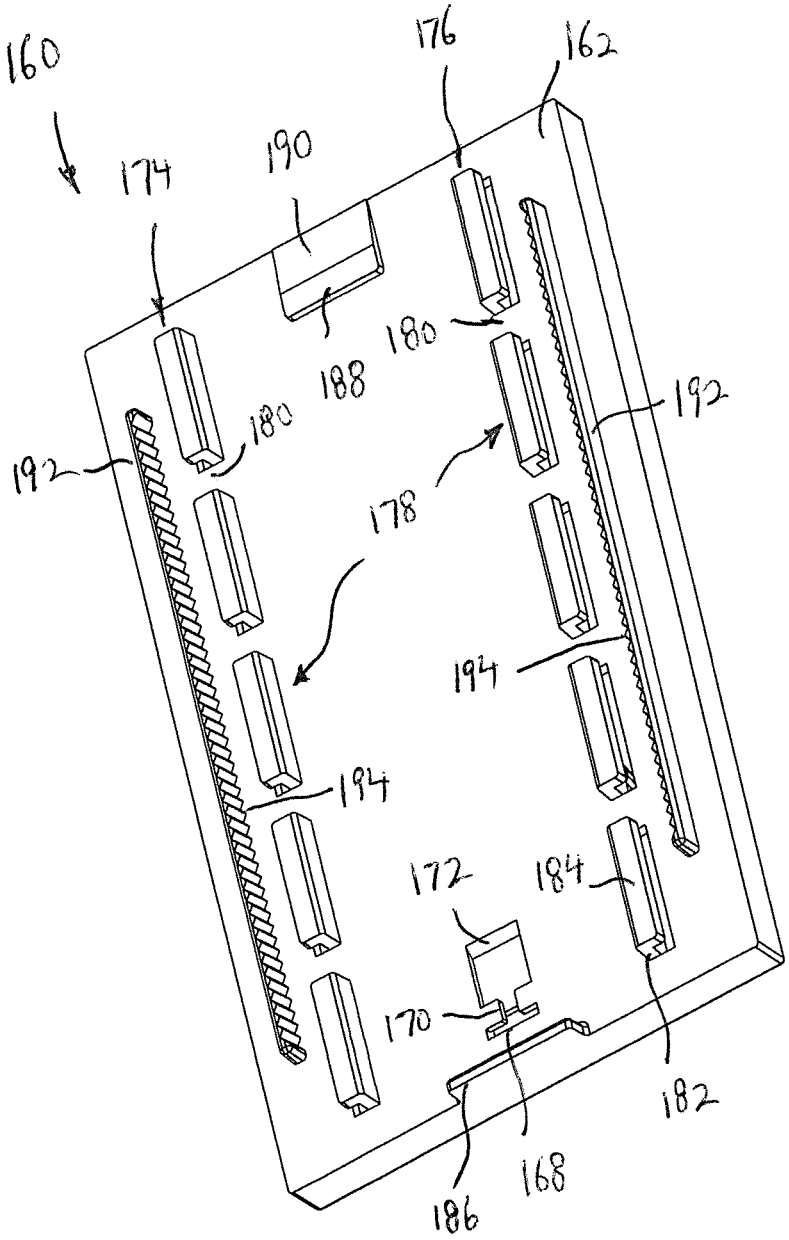
FIG. 21 is a rear perspective view of the slide down door of the theft deterrent slide down door assembly of FIG. 1.
Figure 22:
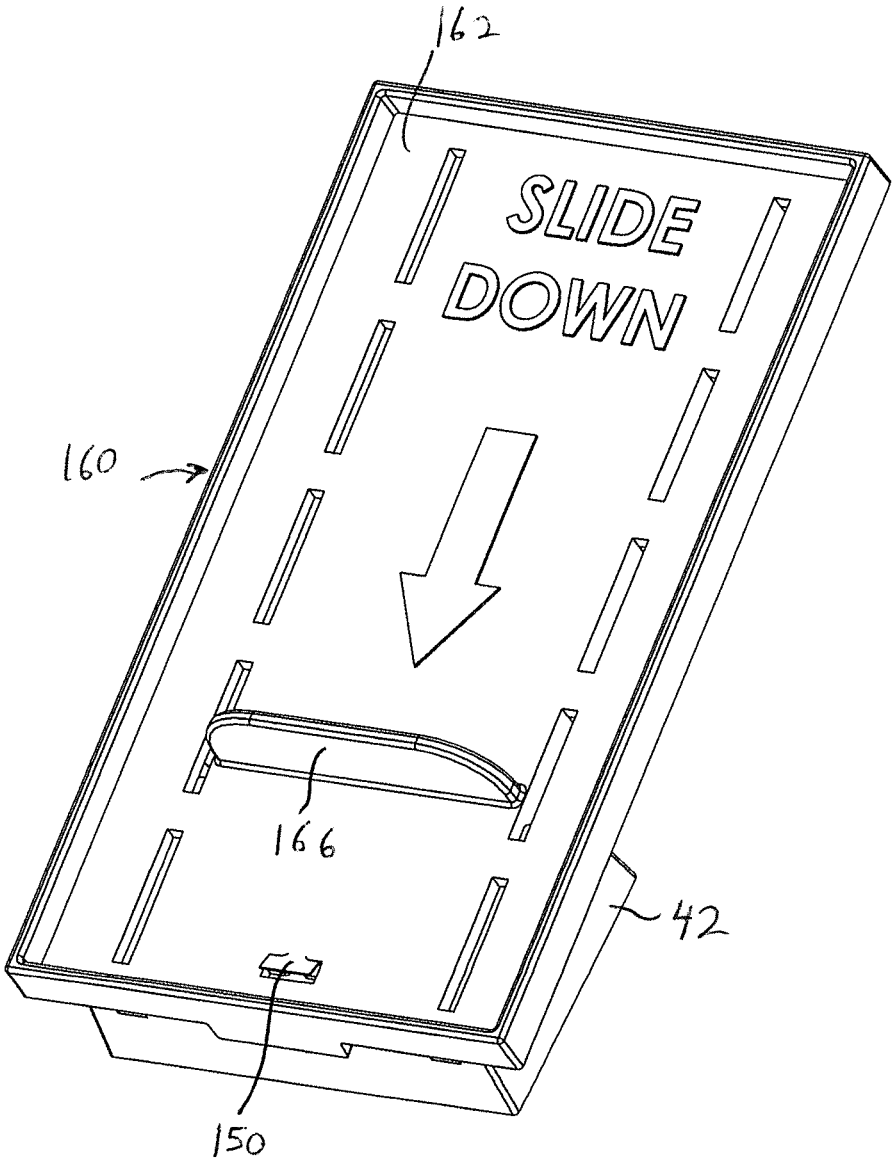
FIG. 22 is a front perspective view of the door connected with the door mounting assembly.
Figure 23:
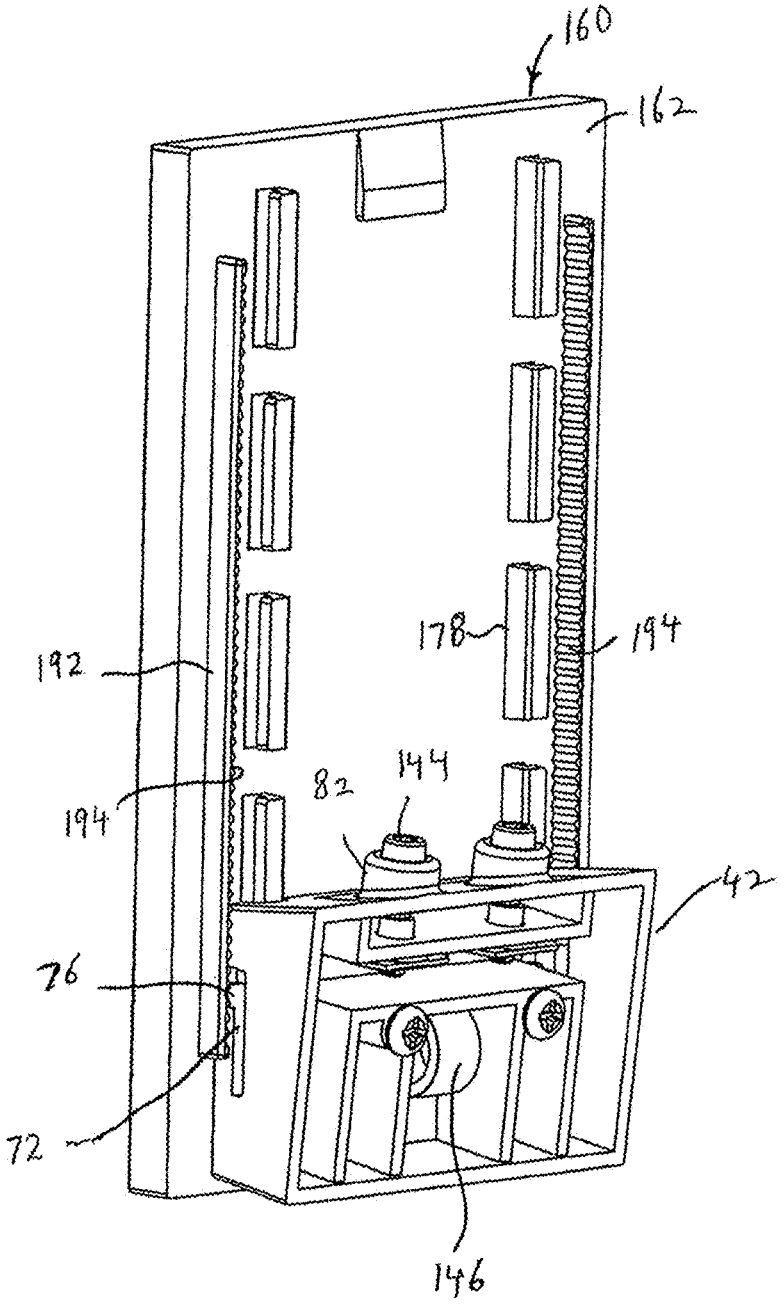
FIG. 23 is a rear perspective view of the door connected with the door mounting assembly, with the bottom bracket and upper bracket removed to better illustrate the operation.

In order to slidably connect slide down door 162 to holder mount 42, the rear surface of transparent panel 162 provided with two columns 174 and 176 of a plurality of vertically aligned L-shaped projections 178. As shown in FIG. 21, column 174 includes five L-shaped projections 178, each in vertical alignment and spaced slightly from each other by a gap 180. Column 174 is positioned at the right side of the rear surface of transparent panel 162, spaced inwardly from the left edge thereof. Column 176 includes five L-shaped projections 178, each in vertical alignment and spaced slightly from each other by a gap 180. Column 176 is positioned at the left side of the rear surface of transparent panel 162, spaced inwardly from the right edge thereof. Each L-shaped projection 178 includes an elongated, vertically oriented wall 182 having one lengthwise edge thereof connected to the rear surface of transparent panel 162 and extending rearwardly thereof in an orthogonal manner, and an elongated horizontally oriented wall 184 connected to the outer free end of vertically oriented wall 182 and extending in a direction away from the L-shaped projections 182 of the other column.

It will be appreciated, however, the present invention is not limited to five spaced apart L-shaped projections 178, and in fact, a single elongated L-shaped projection 178 can be provided on each side of transparent panel 162.

With this arrangement, L-shaped projections 178 slidably fit within elongated vertical openings 53, entry openings 54 and exit openings 56, such that vertically oriented walls 182 slidably fit within narrow vertical slots 58, and horizontally oriented walls 184 are slidably positioned in elongated vertical openings 53 and restrained behind vertical blocking walls 60.

In order to retain slide down door 160 to holder mount 42 and prevent escape therefrom, an abutment ledge 186 extends forwardly from the lower edge of the rear surface of transparent panel 162, at a center thereof, which functions as a limit to upward sliding movement of slide down door 160. As a result, the maximum extent that slide down door 160 can be pulled up is defined by ledge 186 abutting against bottom wall 52 of holder mount 42.

In like manner, an abutment 188 is formed on the rear surface of transparent panel 162 at a position spaced slightly from the upper edge thereof, at a center thereof, which functions as a limit to downward sliding movement of slide down door 160. As a result, the maximum extent that slide down door 160 can be pulled down is defined by abutment 188 abutting against top wall 50 of holder mount 42.

Further, an inclined ramp 190 extends from the upper end of abutment 188 to the top edge of transparent panel 162. This permits slide down door 160 to be slidably positioned within holder mount 42, by pushing L-shaped projections 178 through elongated vertical openings 53, which causes inclined ramp 190 to ride along the front edge of top wall 50 until the lower edge of abutment 188 passes top wall 50 in order to slidably capture slide down door 160 to holder mount 42.

A vertically oriented rack 192 is positioned in spaced, parallel relation to each row 174 and 176, and positioned between the respective row 174, 176 and the respective side edge of transparent panel 162. Each rack 192 includes a plurality of teeth 194 extending along the inner surface thereof in facing relation to the respective row 174, 176 of L-shaped projections 178.

Thus, when L-shaped projections 178 are slidably fit within elongated vertical slot openings 54, the free end of catches 76 of pawls 72 engage with teeth 194, and as slide down door 160 is moved up or down, the engagement of pawls 72 with teeth 194 performs a two-fold purpose. First, this engagement limits the speed at which slide down door 160 can be moved up or down. Second, this engagement creates an audible clicking sound as each pawl 72 is biased out of engagement with one tooth 194 and then engaged with the next tooth 194, in order to alert store personnel that an item is being removed from shelf 12.

It will be appreciated that the free end of constant force flat wound spring 148 is captured within small rectangular opening 168. Specifically, wider free end section 150 is initially fit within larger rectangular recess 172, and slid down behind narrower recess 170, while narrow neck section 148 slides down within narrower recess 170, until wider free end section 150 exits to the front of slide down door 160 through small rectangular opening 168.

In this manner, when slide down door 160 is pulled down by a person via finger hold 166, because wider free end section 150 is captured within small rectangular opening 168, constant force flat wound spring 148 is forced to unwind. After slide down door 160 is pulled down and an item of merchandise is removed, the customer releases finger hold 166, whereby constant force flat wound spring 148 recoils, pulling slide down door 160 back up to its blocking position. However, the engagement of pawls 72 with teeth 194 limits the speed at which slide down door 160 is returned to its blocking position, that is, the movement of slide down door 160 back to the raised position occurs in a slower, orderly or timed manner, rather than a quick jerking action, while also making a sufficiently loud noise, to alert store personnel.

With this arrangement, and since slide down door 160 is pulled back to its blocking position once finger hold 166 is released, it is virtually impossible for a thief to sweep a shelf of merchandise, thereby limiting the removal of one item of merchandise from a row at a time. At the same time, the clicking noise created by pawls 72 and teeth 194 function to alert store personnel that an item is being removed from a shelf.

It will therefore be appreciated that the present invention provides a distinct advantage of preventing theft of merchandise from store shelves 12.

It will be appreciated that various modifications within the scope of the present invention can be made. For example, the lower front face of slide down door 160 can have a recess for receiving an information card as to the product, price, etc. of the product on the shelf 12, thereby eliminating the need for L-shaped clear thermoplastic extrusion 30. Such arrangement would also cover the exit of spring 146 from opening 168.

Having described a specific preferred embodiment of the invention with reference to the accompanying drawings, it will be appreciated that the present invention is not limited to that precise embodiments and that various changes and modifications can be effected therein by one of ordinary skill in the art without departing from the scope or spirit of the invention as defined by the appended claims.

What is claimed is:

1. A theft deterrent slide down door assembly for a merchandise display, comprising:

a door mounting assembly adapted to be mounted to a front of a shelf adapted to display merchandise thereon in rows for purchase by a consumer;

a door slidably mounted in a vertical manner to the door mounting assembly for movement between a first position in blocking relation to prevent removal of the merchandise from the shelf and a second position out of said blocking relation to permit removal of an item of merchandise from the shelf upon application of an external force to said door without changing the position and orientation of the merchandise on the shelf;

a spring arrangement for automatically moving the door back to the first position in the vertically sliding manner from the second position upon release of the external force thereon; and a control arrangement for producing an audible clicking sound during sliding movement of said door.

2. A theft deterrent slide down door assembly according to claim 1, wherein said door mounting assembly includes a holder mount mounted to the front of the shelf, and wherein the spring arrangement is connected between the holder mount and the door for automatically returning the door to the first position upon release of said force.

3. A theft deterrent slide down door assembly according to claim 2, wherein said spring arrangement includes a wound spring positioned in said holder mount and having a free end connected with said door, such that movement of said door to said second position causes said spring to unwind, and upon release of said external force, said spring automatically moves the door back to the first position.

4. A theft deterrent slide down door assembly according to claim 2, wherein said control arrangement is connected between the holder mount and the door for slowing down sliding movement of the door when the door is automatically returned to the first position.

5. A theft deterrent slide down door assembly according to claim 4, wherein said control arrangement includes:

a rack having a plurality of teeth on one of said holder mount and said door; and a pawl on the other of said holder mount and said door, in engagement with said teeth.

6. A theft deterrent slide down door assembly according to claim 1, wherein said control arrangement includes:

a rack having a plurality of teeth on one of said door mounting assembly and said door; and a pawl on the other of said door mounting assembly and said door, in engagement with said teeth.

7. A theft deterrent slide down door assembly according to claim 1, wherein:

said door mounting assembly includes a holder mount mounted to the front of the shelf, and said holder mount includes at least one vertically oriented slot and said door includes at least one vertically oriented projection slidably fit within said at least one vertically oriented slot to limit slidably movement of the door in a linear vertical manner.

8. A theft deterrent slide down door assembly according to claim 7, wherein each said projection has an L-shape, and said holder mount includes at least one blocking wall that prevents escape of said at least one vertically oriented projection while permitting sliding thereof in said at least one vertically oriented slot.

9. A theft deterrent slide down door assembly according to claim 7, wherein the door includes an upper abutment and a lower abutment on a rear surface thereof for providing limits to sliding movement of said door relative to said holder mount.

10. A theft deterrent slide down door assembly according to claim 1, wherein said door mounting assembly includes:

a holder mount to which said door is slidably mounted, and an adjustable securing arrangement connected with said holder mount for mounting said holder mount to the front of the shelf.

11. A theft deterrent slide down door assembly according to claim 1, wherein said door includes a finger hold on a front surface thereof for applying said external force to said door.

* * * * *